US008051839B2

(12) United States Patent
Spadafora et al.

(10) Patent No.: US 8,051,839 B2
(45) **Date of Patent: *Nov. 8, 2011**

(54) INJECTION CONTROL SYSTEM

(75) Inventors: Peter J. Spadafora, Leudelange (LU); Daniel Jeremy Hopley, Chislehurst (GB); Adrian R. Tolliday, Chatham (GB)

(73) Assignee: Delphi Technologies Holdings S.arl, Troy, MI (US)

( * ) Notice: Subject to any disclaimer, the term of this patent is extended or adjusted under 35 U.S.C. 154(b) by 60 days.

This patent is subject to a terminal disclaimer.

(21) Appl. No.: 12/283,338

(22) Filed: Sep. 11, 2008

(65) Prior Publication Data

US 2009/0090333 A1 Apr. 9, 2009

(30) Foreign Application Priority Data

Sep. 14, 2007 (EP) ..... 07253659

(51) Int. Cl.
*F02M 37/04* (2006.01)
*F02M 51/00* (2006.01)

(52) U.S. Cl. ..... 123/498; 123/478; 123/480; 123/494; 701/103; 239/102.2

(58) Field of Classification Search ..... 123/444, 123/472, 478, 480, 486, 494, 498; 701/102–104; 239/102.2

See application file for complete search history.

(56) References Cited

U.S. PATENT DOCUMENTS

| | | | | |
|---|---|---|---|---|
| 5,543,679 | A * | 8/1996 | Morino et al. | 310/316.03 |
| 6,328,019 | B1 * | 12/2001 | Janker | 123/498 |
| 6,486,587 | B2 | 11/2002 | Klenk et al. | |
| 7,422,005 | B2 * | 9/2008 | Hardy et al. | 123/490 |
| 7,576,473 | B2 * | 8/2009 | Berlemont et al. | 310/316.03 |
| 7,617,813 | B2 * | 11/2009 | Pirkl et al. | 123/490 |
| 2007/0157905 | A1 | 7/2007 | Augesky | |
| 2008/0072879 | A1 * | 3/2008 | Nagase et al. | 123/494 |
| 2008/0116855 | A1 * | 5/2008 | Augesky et al. | 320/166 |
| 2010/0036588 | A1 * | 2/2010 | Marzahn | 701/104 |

FOREIGN PATENT DOCUMENTS

| | | |
|---|---|---|
| EP | 2 399 656 | 9/2004 |
| EP | 1 551 065 | 7/2005 |
| EP | 1 860 309 | 11/2007 |
| WO | 2005/071248 | 8/2005 |

OTHER PUBLICATIONS

European Search Report dated Apr. 25, 2008.

* cited by examiner

*Primary Examiner* — Willis Wolfe, Jr.
*Assistant Examiner* — Anthony L Bacon
(74) *Attorney, Agent, or Firm* — Thomas N. Twomey

(57) ABSTRACT

A method of operating a fuel injector including a piezoelectric actuator having a stack of piezoelectric elements, and wherein in use the injector communicates with a fuel rail, the method comprises: applying a discharge current to the actuator for a discharge period so as to discharge the stack from a first differential voltage level across the stack to a second differential voltage level across the stack; maintaining the second differential voltage level for a period of time; and applying a charge current to the actuator for a charge period so as to charge the stack from the second differential voltage level to a third differential voltage level; wherein the third differential voltage level is selected in dependence on at least two engine parameters, the at least two engine parameters selected from: rail pressure; the electric pulse time; and the piezoelectric stack temperature.

24 Claims, 7 Drawing Sheets

INJECTION CONTROL SYSTEM

FIELD OF THE INVENTION

This invention relates to a method of operating a piezoelectric fuel injector. In particular, the invention relates to a method of operating a piezoelectric fuel injector so as to improve its operational life and to maintain fuel injection quantity accuracy.

BACKGROUND OF THE INVENTION

In an internal combustion engine, it is known to deliver fuel into the cylinders of the engine by means of a fuel injector. One type of fuel injector that permits precise metering of fuel delivery is a so-called 'piezoelectric injector'. Typically, a piezoelectric injector includes a piezoelectric actuator that is operable to control movement, directly or indirectly, of a valve needle between injecting and non-injecting states. The valve needle is engageable with a valve needle seating to control fuel delivery through one or more outlet openings in the nozzle of the injector. A hydraulic amplifier may be situated between the actuator and the needle such that axial movement of the actuator causes an amplified axial movement of the needle. An example of a piezoelectric injector of the aforementioned type is described in EP 0995901.

The piezoelectric actuator comprises a stack of piezoelectric elements which, as a whole, are electrically equivalent to a capacitor having a particular capacitance. Changing the voltage applied across the piezoelectric stack alters the amount of electrical charge stored by the stack (also known as its "energisation level") and, therefore, the axial length of the piezoelectric stack. By varying the length of the stack and, thus, the position of the valve needle relative to the seating, the amount of fuel that is passed through the fuel injector can be controlled. In this way, piezoelectric fuel injectors offer the ability to meter precisely a small amount of fuel. A known piezoelectrically operated fuel injector of the aforementioned type is described in our co-pending European patent application EP 1174615.

The amount of charge applied to and removed from the piezoelectric actuator can be controlled in one of two ways. In a charge control method, a current is driven into or out of the piezoelectric actuator for a period of time so as to add or remove, respectively, a demanded charge to or from the stack, respectively. Alternatively, in a voltage control method a current is driven into or out of the piezoelectric actuator until the voltage across the piezoelectric actuator reaches a demanded (predetermined) differential voltage level. In either case, the voltage across the piezoelectric actuator changes as the level of charge on the piezoelectric actuator varies (and vice versa).

Typically, an engine has more than one fuel injector, which may be grouped together in banks of one or more injectors. As described in EP 1400676, each bank of injectors may have its own drive circuit for controlling operation of the injectors. The circuitry includes a power supply, such as a transformer, which steps-up the voltage generated by a power source (e.g. from 12 volts to a higher voltage); and storage capacitors for storing charge and, thus, energy. The higher voltage is applied across the storage capacitors, which are used to power the charging and discharging of the piezoelectric fuel injectors for each injection event. Drive circuits have also been developed, as described in WO 2005/028836A1, which do not require a dedicated power supply, such as a transformer.

In order to initiate an injection of fuel, the drive circuit may be used to cause the differential voltage across the actuator terminals to transition from a high level at which no fuel delivery occurs to a relatively low level at which fuel delivery occurs. An injector responsive to this "drive waveform" is referred to as a "de-energise to inject" injector. Hence, when such de-energise to inject injectors are in their non-injecting state, the voltage across the piezoelectric actuator of the injector is relatively high; whereas in an injecting state the voltage across the actuator is relatively low. Since each fuel injection event is generally relatively rapid, the piezoelectric actuator may be fully energised for approximately 95% of the operating life span.

It has been recognised, however, that the existence of such a high voltage across the piezoelectric actuator for a relatively long portion of the operating cycle of the actuator may cause the degradation ("aging") of the piezoelectric stack, leading to a change in its mechanical and/or electrical properties and, thus, adversely affecting the life span (durability) and performance of the injector. These problems may be attributable, in part, to the higher stress levels exerted on the piezoelectric actuator at the higher differential voltage levels in a non-injecting state. It is also suspected that a high voltage across the terminals of the actuator may encourage the permeation of ionic species into the actuator though its protective actuator encapsulation. In any event, any resultant inaccuracies in fuel volume delivery will have a detrimental effect on combustion efficiency and lead to worse fuel economy and increased exhaust emissions.

It would, therefore, be desirable to provide a piezoelectric actuator-controlled fuel injector that is not subjected to such high differential voltages for such a high proportion of its operating cycle, so as to increase the operational life of the injector and beneficially to maintain fuel injection quantity accuracy.

It would be further advantageous to provide a method of operating a piezoelectric actuator-controlled fuel injector in such a way as to increase the longevity of the injector, and enhance or maintain its ability to deliver predictable and accurate fuel injection quantities.

Thus, the invention relates to a method for operating a piezoelectric fuel injector so as to overcome or at least alleviate at least one of the above-mentioned problems.

SUMMARY OF THE INVENTION

In broad terms, the invention provides methods for operating a piezoelectric actuator-controlled fuel injector in such a way that the high differential voltages to which the piezoelectric actuator is exposed may be reduced (in comparison to conventional piezoelectric injectors), and/or the length of time for which the actuator is exposed to the high differential voltages is reduced. The methods of the invention may further increase the operational life of the injector, and/or maintain or increase fuel injection quantity accuracy.

Accordingly, in a first aspect, the invention provides a method of operating a fuel injector including a piezoelectric actuator comprising a piezoelectric stack, and wherein, in use, the injector communicates with a fuel rail; the method comprising: (a) applying a discharge current ($I_{DISCHARGE}$) to the actuator for a discharge period (T0 to T1) so as to discharge the stack from a first differential voltage level ($V_0$) across the stack to a second differential voltage level ($V_1/V_2$) across the stack (so as to initiate an injection event); (b) maintaining the second differential voltage level for a period of time (T1 to T2; the "dwell period"), (during which the injection event is maintained); (c) determining at least two engine parameters, the at least two engine parameters selected from: fuel pressure in the fuel rail (referred to as "rail pressure", or "P"); $T_{on}$ (the on-time of the fuel injection event); and the piezoelectric stack temperature (Temp); and (d) applying a charge current ($I_{CHARGE}$) to the actuator for a charge period (T2 to T3; T2 to T3') so as to charge the stack from the second differential voltage level to a third differential voltage level ($V_3$) (so as to terminate the injection event). The third differential voltage level ($V_3$) is selected in dependence on the at least two engine parameters.

The injector is most suitably a de-energise to inject injector, in which a fuel injector is triggered by the discharge of the piezoelectric actuator. Advantageously, the at least two engine parameters are determined prior to applying the charge current ($I_{CHARGE}$) to the actuator. The step of determining the at least two engine parameters may include measuring or estimating. Advantageously, the parameter is determined by measurement.

As previously mentioned, the injector typically includes a valve needle which is operable by means of the piezoelectric actuator to engage and disengage from a valve needle seating so as to control the injection of fuel into the engine. Under identical conditions, the differential voltage level across the piezoelectric actuator determines its length. The differential voltage across an actuator is equivalent to the difference in the voltages connected to each of the two terminal of the piezoelectric actuator, such that if one terminal is connect to a voltage source at 250 V and the other terminal is connected to a voltage source at 50 V, the differential voltage level is 200V.

In one embodiment, the step of charging the stack from the second differential voltage level to the third differential voltage level ($V_3$) is controlled by a drive circuit, which comprises a high voltage rail at a voltage $V_{HI}$ and a low voltage rail at a voltage $V_{LO}$, which are connectable to respective terminals of the piezoelectric actuator.

The drive circuit suitably comprises a mechanism for charging a high-voltage or "top" rail, which is used to (re-) charge (i.e. energise) the actuator. If the top rail and the piezoelectric actuator are connected for a sufficient time period, the differential voltage across the actuator equilibrates to the difference between $V_{HI}$ and $V_{LO}$. Thus, the top rail sets the maximum voltage of the actuator and the low-voltage or "bottom" rail is provided to set the minimum voltage of the actuator. Switches are conveniently provided in the drive circuit to control the connection of the actuator between the top and bottom rails for charging and discharging purposes. The drive circuit may further comprise two storage capacitors that are used for charging and discharging the piezoelectric actuator, respectively. A first storage capacitor may be provided, wherein the voltage of the high voltage rail is reduced by removing charge from the first storage capacitor.

Conveniently, the drive circuit comprises or receives a voltage source or power supply ($V_s$), for example, from an engine control unit (ECU), which is conveniently stepped up, e.g. to between 50 and 60 V, from a typically 12 V engine battery.

Beneficially, the drive circuit is employed to control the charging and discharging of the piezoelectric actuator and, in this way, the associated piezoelectric fuel injector(s) can be dynamically controlled. In one embodiment, this control is achieved by using two storage capacitors which are alternately connected to the fuel injector arrangement/electronic circuitry. Conveniently, a first storage capacitor is connected to the injector arrangement during a charging phase, which terminates an injection event; while a second storage capacitor is connected to the injector arrangement during a discharge phase, thereby initiating an injection event. A regeneration switch may be used at the end of the charging phase (T2 to T3; T2 to T3') and before a subsequent discharge phase (T0 to T1), to replenish the first storage capacitor and allow the high voltage of the charged actuator to be re-established via the top rail.

An engine generally comprises a plurality of fuel injectors and, therefore, the method of the invention may be used to operate a plurality of fuel injectors at the same time, within an engine. Further, in use, a fuel injector of an engine generally provides more than one fuel injection event over a continuous period of engine operation: for example, each injector may deliver one or more injections per second (such as 1, 2, 3 or 4 injections per second), depending on the engine speed and/or load. Hence, it should be appreciated that steps (a) to (d) above relate to the steps of a single fuel injection event (or one fuel injection "cycle") and, typically, the operation of a fuel injector and ultimately an engine using the method of the invention may involve a plurality of such fuel injection cycles/events. Hence, where a fuel injector is operated according to the method of the invention and there is at least two consecutive fuel injection events, it should be understood that the above-mentioned "third differential voltage level", ($V_3$) of a preceding fuel injection event may conveniently also represent the above-mentioned "first differential voltage level", ($V_0$) of the immediately subsequent fuel injection event.

By selecting the third differential voltage level on the basis of the at least two engine parameters relevant to a fuel injection event, the voltage at which the piezoelectric actuator is held between adjacent injections may be selected to minimise the charge on the piezoelectric actuator when the injector is held closed, while not compromising the ability of the injector to provide an accurate fuel injection quantity at the required moment.

In one embodiment, the step of determining the at least two engine parameters includes measuring or estimating the selected parameter: (1) prior to the start of the discharge period; and/or (2) during the discharge period (T0 to T1); and/or (3) during the dwell period (T1 to T2). Thus, each of the relevant engine parameters may be determined at a different period (or interval) of the fuel injection cycle; during more than one of the periods (1) to (3) above, or two or more parameters may be determined during the same interval. By way of example, rail pressure and $T_{on}$ may be determined prior to the start of the discharge period, and stack temperature may be determined during the discharge period. In each case, however, the relevant engine parameter is determined prior to the subsequent charge period in step (d).

Suitably, the at least two engine parameters are rail pressure and $T_{on}$. In an advantageous embodiment, the third differential voltage level ($V_3$) is selected in dependence on all three of rail pressure, $T_{on}$, and piezoelectric stack temperature. Thus, the third differential voltage level is advantageously selected as a function of rail pressure, $T_{on}$, and piezoelectric stack temperature (e.g. $V_3=f(P, T_{on}, Temp)$). The means by which the determined engine parameters are manipulated and/or interpreted to output the third differential voltage level may, collectively, be considered to be "means for data comparison". The means for data comparison may be any suitable system or combination of systems, such as one or more look-up tables, data maps, scale functions, equations and so on.

It has been recognised that a greater actuator displacement is required at relatively high rail pressures to achieve the same amount of needle lift as would be achieved at a lower rail pressure, because the forces trying to close the injector needle increase with pressure in the rail. Therefore, at relatively low rail pressures, it is possible to reduce the absolute voltage across the actuator in its energised state, without compromising needle lift and the consequential fuel injection event. Accordingly, by selecting the energised level of the actuator (i.e. the third differential voltage level) in dependence on fuel pressure in a fuel rail of an engine, in one way, the method of the invention operates to reduce the voltage across a piezoelectric actuator in a fuel injector when in its energised (non-injecting) state; which allows the injector to be operated more efficiently and without compromising needle lift to the detriment of injector operation. In more detail, if rail pressure is relatively low, the engine does not demand a large amount of fuel to be injected and so only a small discharge of the piezoelectric actuator is necessary to achieve the required small needle displacement and small quantity of fuel injection. Accordingly, it is not necessary for the piezoelectric actuator to be held at a high differential voltage level in order to allow for a large drop in differential voltage for fuel injection; and hence, following the preceding fuel injection event, it may be possible to recharge the piezoelectric actuator of the injector to a third differential voltage level ($V_3$), which is lower than the differential voltage level across the stack before the preceding fuel injection event (i.e. the first differential voltage level, $V_0$). By reducing the voltage differential across the piezoelectric stack under such circumstances, the actuator is subjected to a reduced stress when in a non-injecting state, which may benefit injector life. Also, the permeation of ionic species into the actuator though the protective actuator encapsulation will tend to be reduced when there is a lower voltage drop across the stack. Conversely, for example, after a period in which the engine has been at idle, rail pressure may rapidly increase and the third differential voltage level ($V_3$) may be selected to be greater than the first differential voltage level. Thus, the selected differential voltage level of the actuator in its energised state may be, to a certain extent, proportional to rail pressure.

It can be convenient to refer to the energised level/state (or the "charged level", $V_{CHARGE}$) of the piezoelectric actuator, and it should be understood that for the purposes of this description, the energised level of the piezoelectric actuator can be considered to encompass both the first differential voltage level and the third differential voltage level. The invention has an aim of maintaining the energised level of a piezoelectric actuator of a fuel injector at as low a differential voltage as possible for as long a duration of its operating period as possible. Suitably, the differential voltage is less than 250 V, or less than 200 V; advantageously, it is in the range of 200 to 150 V, or in the range of 200 to 100 V. More advantageously, the method of the invention has the intention of maintaining the charged level of the actuator in the range of 180 to 100 V, or 150 to 100 V for the majority of the time (i.e. at least 50% or the time) that the fuel injector is active.

In addition to selecting the third differential voltage level in dependence on rail pressure, the third differential voltage level may be varied as a function of the predetermined electric pulse time ($T_{on}$) of the next (subsequent) fuel injection event. The electric pulse time is often considered to be the time period over which the fuel injection event takes place, and (in a de-energise to inject injector) it consists of the discharge period (T0 to T2), which includes the discharge phase (T0 to T1) and the dwell period (T1 to T2) of the actuator.

The method of the invention beneficially takes account of the predetermined $T_{on}$ for the next fuel injection event to target/select a desirable charged level for the piezoelectric actuator (i.e. the above-described third differential voltage level) before or during the preceding (or current) injection event. This embodiment provides the particular advantage that during periods when the engine is idle and, hence, when only a limited amount of needle lift is required for very short durations of time in order to keep the engine ticking over, the energised differential voltage across the actuator may be reduced to a minimum level that is sufficient to enable the small charge charges required for needle lift. Furthermore, since (under some operating conditions) an engine may be idle for a significant proportion of its operating period, the invention optimises the voltage control of the piezoelectric actuator throughout its operating life.

To the extent that $T_{on}$ for the next fuel injection event is determined on the basis of engine load, engine speed and/or throttle position, the third differential voltage level may also be varied as a function of engine load, engine speed or throttle position, or a combination of more than one of these engine parameters.

In a further embodiment, the third differential voltage level may be selected as a function of stack temperature. Stack temperature can be a relevant engine parameter for a number of reasons, for example: at some operating temperature a piezoelectric stack is put under increased stress, which can mean that large and/or rapid changes in stack length may increase the probability of damage to the stack; and also, the capacitance of a piezoelectric stack can be directly affected by its temperature. Hence, if the temperature of the stack is known it may be possible to control a fuel injector in a temperature dependent manner, thus, providing accurate and predictable metering of fuel at engine start-up (e.g. when the actuator may be relatively cold) and during prolonged periods of engine activity (e.g. when the actuator is relatively warm); and helping to prolong the lifespan of the actuator. To a certain extent, the differential voltage level of the actuator in its energised state may be selected to be inversely proportional to stack temperature, because the stack is more likely to be damaged by length changes at high temperatures. Under some operating conditions, the piezoelectric stack may be more responsive to charge level changes at higher temperatures than it is at lower temperatures, and so the amount of charge change may be adjusted accordingly.

Our co-pending application, EP 1811164 describes methods by which the stack temperature of a piezoelectric actuator may be determined (measured or estimated), which methods are incorporated herein by reference. In one embodiment piezoelectric stack temperature may be measured directly during operation. However, due to the encapsulation of an actuator in a fuel injector, it may be more convenient to measure stack temperature during operation in an indirect manner, such as based on measurements of engine parameters taken and/or calculated and/or modelled during engine calibration.

Suitably, the third differential voltage level is selected from one or more look-up tables, data maps, equations or scale functions based on calibration data. Calibrations are conveniently carried out by an engine/system manufacturer, prior to supply and/or fitment of a fuel injection system to a vehicle.

The third differential voltage level may be a step-change function of the at least two engine parameters or may be a linear function of the at least two engine parameters.

In an advantageous embodiment, the third differential voltage level is selected using a means of data comparison, such as a data map, look-up table, scale function or equation, relating $T_{on}$ and rail pressure. Suitably, the means of data comparison is a data map or look-up table based on $T_{on}$ and rail pressure. In one embodiment, $T_{on}$ is used in conjunction with rail pressure in the form of a data map to obtain an output of the third differential voltage level. By way of example, the third differential voltage level may be selected to be a minimum suitable level when both rail pressure and $T_{on}$ are at or near their respective minimums.

Alternatively, in a convenient embodiment, the output may provide the third differential voltage level in a more indirect manner, by providing a value for the top rail voltage that should be applied to one terminal of the piezoelectric actuator in order to achieve a required third differential voltage level (given that the low voltage level of the second actuator terminal is known). In this regard, it will be appreciated by the skilled person in the art, that the differential voltage across a piezoelectric actuator is the difference between the voltage levels connected to each of the two actuator terminals.

When stack temperature is also considered, the output from the data map, look-up table or scale function relating $T_{on}$ and rail pressure may be inputted into a further means of data comparison, such as a scale function, or data map relating to the temperature of the piezoelectric stack. Thus, in one beneficial embodiment, the process of selecting the third differential voltage level includes: obtaining a first output from a data map relating rail pressure and $T_{on}$; and obtaining a second output by applying a scale function based on stack temperature to the first output; and wherein the second output corresponds to the required third differential voltage level. In another suitable embodiment, the process of selecting the third differential voltage level includes: obtaining a first output from a data map relating rail pressure and $T_{on}$; and obtaining a second output from a data map relating stack temperature to the first output; and wherein the second output corresponds to the required third differential voltage level. Alternatively, the second output corresponds to the required top rail voltage connected to the piezoelectric actuator in order to achieve a desired third differential voltage level.

In another embodiment, the third differential voltage level may be selected by the process of: applying three scale functions, one scale function based on each of rail pressure, $T_{on}$, and piezoelectric stack temperature.

Having selected a suitable third differential voltage level, at the end of the fuel injection event (i.e. at the end of the electric pulse time) the method further comprises applying a charge current ($I_{CHARGE}$) to the actuator for a charge period (T2 to T3 or T2 to T3') so as to charge the stack from its level during a fuel injection event (i.e. the second differential voltage level) to the selected third differential voltage level ($V_3$) in order to terminate the fuel injection event.

The third differential voltage level to which the stack is recharged may be adjusted (in dependence on the at least two engine parameters) in any suitable manner, for example, by: adjusting the level of a voltage source (e.g. a high voltage rail; $V_{HI}$) to an actuator terminal; or by controlling the amount of charge reapplied to the actuator during the re-charging period (T2 to T3; T2 to T3') of the actuator following a discharge event. The adjustment to the voltage level of the high voltage source to the actuator may be achieved in any suitable manner. For example, in some circumstances it may be possible to actively reduce the top rail voltage by means of electronic circuitry and/or control means. Conveniently, the voltage level of the high voltage source ($V_{HI}$) of the actuator is reduced in a passive step-wise manner, by selectively not re-charging the top rail to its previous high level following any reduction in the voltage of the top rail. A reduction in the top rail voltage results, by way of example, when it is used to re-charge a piezoelectric actuator.

In one embodiment of the invention, the differential voltage across a piezoelectric actuator is controlled by way of a drive circuit that comprises regeneration switch circuitry. The regeneration switch circuitry may first comprise a first storage capacitor that may be used to regenerate the voltage of the top rail when the voltage has been reduced to below its previous level. Suitably the regeneration switch circuitry is operable by an ECU to vary the charge that is returned to the first storage capacitor during a regeneration phase at the end of an injection event. Since the charge on the first storage capacitor determines the voltage level of the high voltage rail of the drive circuit, by adjusting the time for which the regeneration circuitry is operated, the maximum voltage level of the top rail and, hence, the maximum voltage to which the piezoelectric actuator can be recharged may be controlled.

Thus, in a passive mechanism for reducing the top rail voltage, the method may comprise breaking the connection between the first storage capacitor used to recharge the top rail and the top rail (e.g. by way of a switch) for a period of time. During the period of disconnection, any drop in the voltage of the top rail, for example, that may be result from the re-charging (by the top rail) of an actuator, is not compensated through charging of the top rail from the first capacitor of the drive circuit.

In a passive mechanism for reducing the top rail voltage, the top rail voltage may, for example, be reduced by a few volts (e.g. 10 V or less, such as by 0 to 5 V) per fuel injection event. Given the frequency of fuel injection events in an active engine, the voltage of the top rail may be reduced in this manner by 50 V in a few seconds.

In another embodiment, the drive circuit may comprise a means of actively discharging the above-mentioned first storage capacitor, to actively remove a significant amount of charge stored and, thereby, actively reduce the voltage of the top rail.

In another embodiment, the method of the invention may comprise selecting a charge period (or charge time, T2 to T3 or T2 to T3') during which the charge current is applied to the actuator so as to achieve the third differential voltage level across the actuator. In such an embodiment, the maximum voltage of the top (high-voltage) rail may be constant or may vary, for example, as discussed above. The selected charge period may conveniently be used to control the maximum differential voltage level across the actuator. For instance, for a constant top rail voltage of e.g. 250 V and a constant low rail voltage of e.g. 50 V, reducing the charge period (T2 to T3 or T2 to T3') will result in a lower third differential voltage level ($V_3$), provided that the reduced charge period is less than the time required for the actuator to reach the voltage of the top rail. Therefore, in this embodiment, the method includes, subsequent to selecting a third differential voltage level in dependence on the at least one engine parameter, selecting a charge time for which the charge current is applied so as to achieve the selected third differential voltage level.

In the above-described methods, the change in the voltage across the actuator from the first differential voltage level to the third differential voltage level (via the second differential voltage level) may be implemented stepwise (for example, via intermediate voltage levels, $V_{3'}$), or in a single step. A passive mechanism for reducing the top rail voltage (and hence the third differential voltage level) is conveniently implemented in a stepwise manner, such that the desired target third differential voltage level is achieved via a plurality of intermediate voltage levels $V_{3'}$, which successively converge on the target third differential voltage level. For instance, the target third differential voltage level $V_3$ may be obtained by carrying out a plurality of successive fuel injection events, each of which serves to reduce the voltage of the top rail by a few volts (e.g. 1 to 5 V per fuel injection event) and, thus, reduce the differential voltage across the piezoelectric stack (as previously described), until the desired third differential voltage level is achieved.

Accordingly, in one embodiment, step (d) of the method of the invention may comprise the steps of: (b1) selecting the third differential voltage level ($V_3$); (b2) applying a charge current ($I_{CHARGE}$) to the actuator for a charge period (T2 to T3') so as to charge the stack from the second differential voltage level to an intermediate differential voltage level ($V_{3'}$), wherein the intermediate voltage level is a level between the first and third differential voltage levels; and (b3) repeating steps (a), (b), (c), (b1) and (b2) until the intermediate differential voltage level $V_{3'}$ equals or approximates (i.e. converges on) the third differential voltage level; wherein the intermediate differential voltage level ($V_{3'}$) obtained in a first (or preceding) step (b2) is taken to be the first differential voltage level ($V_0$) in a second (or successive) step (b1).

Suitably, the intermediate differential voltage level ($V_{3'}$) is lower than the first voltage level, such that on performing steps (a), (b), (b1) and (b2), the high differential voltage level ($V_0$; $V_{3'}$) of the actuator when in the non-injecting state is reduced stepwise until in reaches the target, third differential voltage level ($V_3$). Conveniently, the reduction in the differential voltage level of an energised piezoelectric actuator is reduced via a passive mechanism, e.g. by preventing the recharging of the top rail of a drive circuit by a (first) capacitor capable of providing a voltage source to the top rail (as previously described). In an alternative embodiment, however, the intermediate voltage levels are achieved via an active mechanism. In an active mechanism for reducing the differential voltage level, an ECU for example, may control the charge period (T2 to T3') during which the piezoelectric stack of the actuator receives a charging current from the top rail of a drive circuit. Alternatively, where it is necessary to increase the energised differential voltage level of the piezoelectric stack, an active mechanism may comprise increasing the voltage of the top rail ($V_{HI}$), for example, by increasing the amount of charge on a first storage capacitor for regenerating the top rail, or by increasing the regeneration time of the top rail.

The invention further recognises that simply reducing (or increasing) the voltage of a piezoelectric actuator can cause additional artefacts, particularly as regards injection quantity accuracy. In this regard, due to the inherent properties of piezoelectric material, the displacement of a piezoelectric actuator stack and, hence, the extent of displacement of an injection valve needle, is not only dependent on the overall charge movement (i.e. the amount of charge added or removed from the stack), but also on the magnitude of the differential voltage across the actuator terminals. If the magnitude of the differential voltage across the terminals of the actuator is reduced from e.g. 200 V to 150 V, the magnitude of the actuator displacement may also be reduced for an equivalent differential voltage drop. By way of example, if operating an actuator by voltage control, a differential voltage drop of e.g. 150 V starting from a differential voltage level of 200 V, may result in a larger displacement of the piezoelectric stack (and hence of an associated injection valve needle), than an equivalent differential voltage drop of 150 V from 150 V to 0 V. Similar problems may exist when operating an actuator via charge control. Therefore, by changing the absolute differential voltage or charge on a piezoelectric actuator, the operation of the actuator may also be affected.

Meanwhile, the rate of the charge change (or change in differential voltage) on a piezoelectric actuator that is used to control a fuel injection valve can determine the rate of valve needle displacement and, hence, the rate at which the injection valve opens and/or closes to start or end a fuel injection event, respectively, and thus, the amount of fuel injected during a fuel injection event. In other words, at a constant initial differential voltage of e.g. 200 V, a faster rate of discharge of the piezoelectric stack may result in a faster rate of contraction of the stack, a faster opening of an associated fuel injection nozzle, and potentially an increase in the amount of fuel that is injected over a particular time period.

In fact, both the inherent properties of the piezoelectric material of an actuator and the injector design, mean that both the rate and the amount of expansion (or contraction) of an actuator in a fuel injector can be affected by a number of factors, including: the operating differential voltage level; the change in differential voltage; the pressure of fuel contacting the actuator; and the temperature of the actuator. To account for some of the factors (e.g. engine parameters) that can affect the extent and rate of response of a piezoelectric actuator, the methods of the invention may further comprise applying one or more compensations.

Accordingly, in one embodiment the method of the invention may further comprise applying at least one of: (i) a discharge current compensation to select the discharge current ($I_{DISCHARGE}$) used to discharge the stack in step (a); (ii) a charge current compensation to select the charge current ($I_{CHARGE}$) used to charge the stack in step (d); and (iii) an opening discharge compensation to select the amount of charge removed from the stack to achieve the second differential voltage level in step (b).

In step (i), the discharge current compensation is applied to select an appropriate discharge current ($I_{DISCHARGE}$) to cause the injection valve to open (via piezoelectric stack contraction and the resultant valve needle lift) at a predetermined rate. In this way, the start of a fuel injection event may be controlled by controlling the rate of contraction of the piezoelectric stack of an actuator. Suitably, the amount of discharge current compensation is determined in dependence on one or more engine parameters, such that the opening rate of the fuel injector valve is largely, substantially or entirely independent on those parameters.

In step (ii), the charge current compensation is applied to select an appropriate charge current ($I_{CHARGE}$) to cause the injection valve to close (via piezoelectric stack extension and the resultant valve needle closing) at a predetermined rate. Thus, the end-point of a fuel injection event may be controlled by controlling the rate of extension of the piezoelectric stack of an actuator. The amount of charge current compensation is suitably determined in dependence on one or more engine parameters, such that the closing rate of the fuel injector valve is largely, substantially or entirely independent on those parameters.

In step (iii), the opening discharge compensation is applied to select an appropriate quantity of charge to remove from the piezoelectric stack to cause the injection valve to open (via piezoelectric stack contraction and the resultant valve needle lift) by a predetermined amount. In this way, the amount of fuel injected into an associated engine cylinder during a fuel injection event may be controlled by controlling the volume of fuel that can pass between the injection needle and its seating in a known period of time. Again, the amount of opening discharge compensation is determined in dependence on one or more engine parameters, such that the opening extent of the fuel injector valve is largely, substantially or entirely independent on those parameters.

In an advantageous embodiment, the method comprises applying two compensations selected from the above-mentioned discharge current compensation, charge current compensation and opening discharge compensation; and more advantageously, the method comprises applying all three compensations in dependence on one or more engine parameters. The one or more engine parameters is suitably selected from: rail pressure (P); piezoelectric stack temperature (Temp); and the first differential voltage level ($V_0$).

In one aspect, therefore, the invention relates to a method of operating a fuel injector including a piezoelectric actuator having a stack of piezoelectric elements, wherein in use the injector communicates with a fuel rail, the method comprising applying a discharge current to the actuator to discharge the stack from a first differential voltage level ($V_0$) across the stack to a second differential voltage level ($V_1/V_2$) across the stack. The discharge current is selected by applying a discharge current compensation technique to a predetermined discharge current to modify the discharge in dependence on one or more engine parameters such that the opening rate of the fuel injector is largely, substantially or entirely independent of said one or more parameters. The second differential voltage level is maintained across the stack for a period of time (T1 to T2); and a charge current ($I_{CHARGE}$) is applied to the actuator (11) so as to charge the stack from the second differential voltage level to a third differential voltage level ($V_3$) selected in dependence on at least two engine parameters selected from: fuel pressure in the fuel rail (rail pressure, P); the electric pulse time ($T_{on}$); and the piezoelectric stack temperature (Temp). The charge current is selected by applying a charge current compensation technique to a predetermined charge current to modify the charge in dependence on one or more engine parameters such that the closing rate of the fuel injector is largely, substantially or entirely independent of said one or more parameters.

The one or more engine parameters is conveniently determined (i.e. measured or estimated): (1) prior to the start of the discharge period (T3 to T0); and/or (2) during the discharge period (T0 to T1); and/or (3) during the dwell period of a particular fuel injection event (T1 to T2). Suitably, the discharge current compensation and, hence, the discharge current ($I_{DISCHARGE}$) is determined prior to the start of the discharge period, such that it may be applied at the start of the discharge period. Conveniently, the charge current compensation is determined prior to the start of the discharge period, during the discharge period, or during the dwell period of a particular fuel injection event, so that it may be applied at the end of the dwell period (i.e. at the start of the charge phase, T2 to T3; T2 to T3') to end the fuel injection event. Typically, the opening discharge compensation is determined prior to the start of the discharge period, or during the discharge period (T0 to T1); and applied during or at the end of the discharge period to control the charge level to on the actuator at the second differential voltage level (i.e. when the fuel injector is open).

Advantageously, the method of the invention comprises applying: (i) a discharge current compensation to select the discharge current ($I_{DISCHARGE}$) used to discharge the stack in step (a); (ii) a charge current compensation to select the charge current ($I_{CHARGE}$) used to charge the stack in step (c); and (iii) an opening discharge compensation to select the amount of charge removed from the stack to achieve the second differential voltage level in step (b); wherein the discharge current compensation, the charge current compensation and the opening discharge compensation are each independently determined as a function of rail pressure (P), piezoelectric stack temperature (Temp), and the first differential voltage level ($V_0$).

In a second aspect, the invention provides a drive circuit for a fuel injector including a piezoelectric actuator having a stack of piezoelectric elements, the drive arrangement comprising: (A) a first element or elements for applying a discharge current ($I_{DISCHARGE}$) to the actuator for a discharge period (T0 to T1) so as to discharge the stack from a first differential voltage level ($V_0$) across the stack to a second differential voltage level ($V_1$) across the stack (so as to initiate an injection event); (B) a second element or elements for maintaining the second differential voltage level for period of time (T1 to T2, the "dwell period"), (during which the injection event is maintained); (C) a third element or elements for applying a charge current ($I_{CHARGE}$) to the actuator for a charge period (T2 to T3; T2 to T3') so as to charge the stack from the second differential voltage level to a third differential voltage level ($V_3$) (so as to terminate the injection event); and (D) a fourth element or elements for determining at least two engine parameters prior to applying the charge current ($I_{CHARGE}$) to the actuator such that the third differential voltage level to which the stack is charged is selected in dependence on the at least two engine parameters, the at least two engine parameters selected from: fuel pressure in the fuel rail (referred to as "rail pressure", or "P"); $T_{on}$ (the on-time of the fuel injection event); and the piezoelectric stack temperature (Temp).

As described with respect to the first aspect of the invention, in the second aspect of the invention, the third differential voltage level to which the stack is charged is suitably selected as a function of at least rail pressure and $T_{on}$. More suitably, the third differential voltage level is selected as a function of at least rail pressure, $T_{on}$, and piezoelectric stack temperature (Temp).

In one embodiment, the drive circuit of the invention may further include: (E) a fifth element or elements for applying a discharge current compensation to select the discharge current ($I_{DISCHARGE}$) used to discharge the stack; and/or (F) a sixth element or elements for applying a charge current compensation to select the charge current ($I_{CHARGE}$) used to charge the stack; and/or (G) a seventh element or elements for applying an opening discharge compensation to select the quantity of charge to remove from the piezoelectric stack to, cause the injection valve to open to the required extent; and (H) an eighth element or elements for determining at least two engine parameters; wherein the at least two engine parameters are selected from rail pressure (P), piezoelectric stack temperature (Temp), and the first differential voltage level ($V_0$).

Conveniently, the compensations in the first and second aspects of the invention are determined by an ECU and may suitably be implemented by way of a drive circuit.

In this way, as described in relation to the methods of the invention, the drive circuit may advantageously be used to control a piezoelectric actuator in a fuel injector to regulate the opening and closing of the fuel injector and, thereby, accurately control the rate and quantity of fuel delivered to an engine cylinder in a fuel injection event. Suitably, the discharge current compensation, the charge current compensation and the opening discharge compensation are each independently determined as a function of rail pressure (P), piezoelectric stack temperature (Temp), and the first differential voltage level ($V_1$).

It will be appreciated that the drive circuit embodiments of the second aspect of the invention may comprise any further elements or means necessary for performing/implementing any of the method steps of the first aspect of the invention.

In a third aspect the invention provides a computer program on a computer readable memory or storage device for execution by a computer, the computer program comprising at least one computer program software portion which, when executed, is operable to implement any method of the invention.

In a fourth aspect, the invention provides a data storage medium having the or each computer software portion of the third aspect of the invention stored thereon.

In a fifth aspect the invention provides a microcomputer provided with the data storage medium of the fourth aspect of the invention.

These and other aspects, objects and the benefits of this invention will become clear and apparent on studying the details of this invention and the appended claims.

BRIEF DESCRIPTION OF THE DRAWINGS

The invention will now be described, by way of example, with reference to the accompanying drawings in which.

DETAILED DESCRIPTION OF THE INVENTION

Figure 1A:
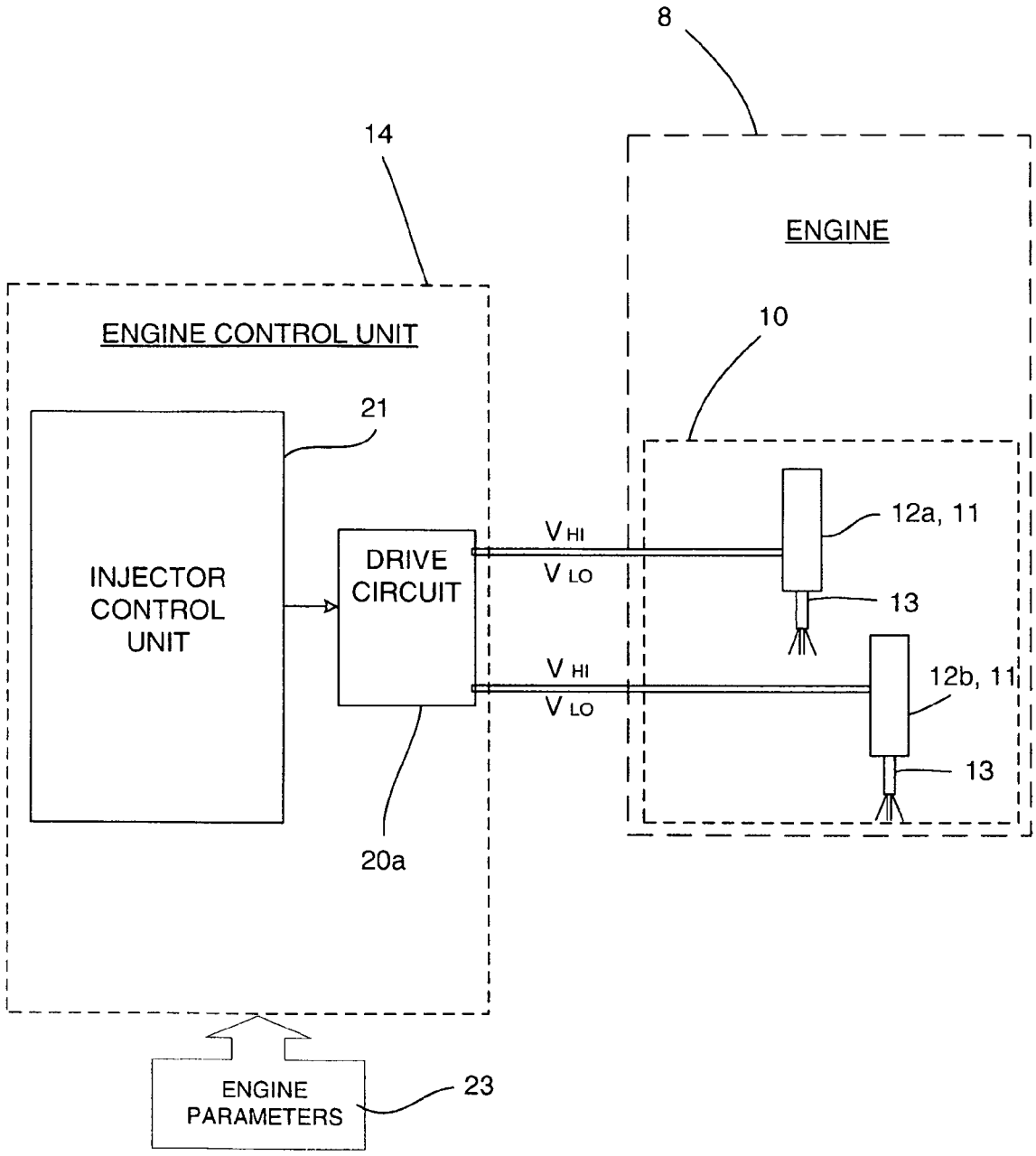
FIG. 1 is a schematic diagram of: (A) a fuel injection system including a piezoelectric injector and an engine control unit (ECU) comprising a drive circuit, and (B) a piezoelectric actuator controlled fuel injector.
Figure 1B:
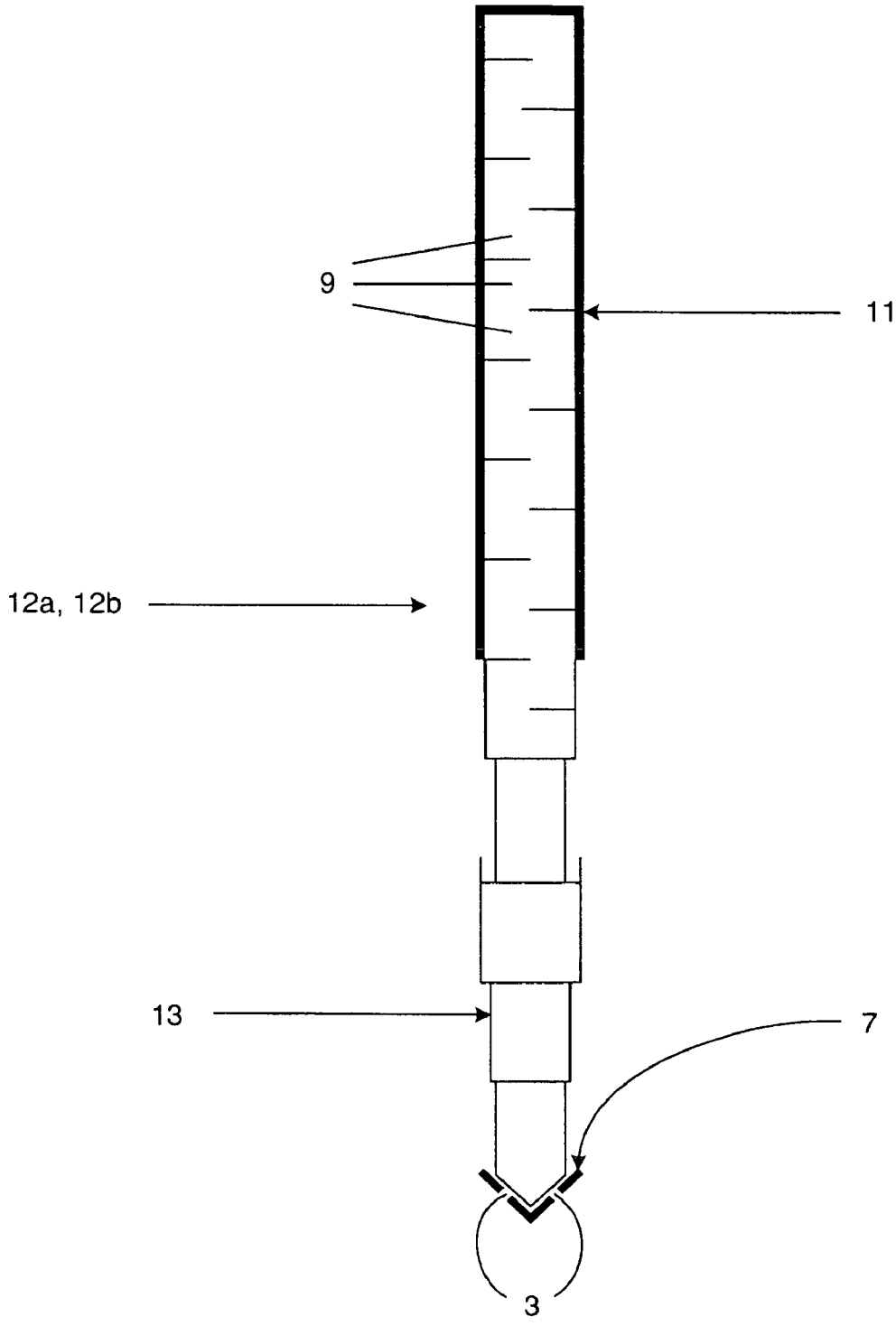

With reference to FIGS. 1A and 1B, an engine 8, such as an automotive vehicle engine, is generally shown having an injector arrangement comprising a first fuel injector 12*a* and a second fuel injector 12*b*. The fuel injectors 12*a*, 12*b* each have an injector valve needle 13 and a piezoelectric actuator 11 comprising a stack of piezoelectric elements 9. The piezoelectric actuator 11 is operable to control the position of an injector valve needle 13 relative to a valve needle seating 7. Depending on the voltage across the terminals of the piezoelectric actuator 11, the valve needle 13 is either caused to disengage the valve needle seating 7, in which case fuel is delivered into an associated combustion chamber/cylinder (not shown) of the engine 8 through a set of nozzle outlets 3; or is caused to engage the valve needle seating 7, in which case fuel delivery is prevented.

The fuel injectors 12*a*, 12*b* may, for example, be employed in a compression ignition internal combustion engine to inject diesel fuel into the engine 8, or they may be employed in a spark ignited internal combustion engine to inject combustible gasoline into the engine 8.

The fuel injectors 12*a*, 12*b* form a first injector set 10 of fuel injectors of the engine 8 and are controlled by means of a drive circuit 20*a*. In practice, the engine 8 may be provided with two or more injector sets (10), each containing one or more fuel injectors and each injector set having its own drive circuit 20*a*. Thus, although in FIG. 1A the engine is depicted with two fuel injectors 12*a*, 12*b*, it will be appreciated that any suitable number of fuel injectors may be provided in an engine. For example, the engine may contain one or more fuel injectors, for example, 1, 2, 3, 4, 5, 6, 10, 12, 16 or more fuel injectors. Where possible, for reasons of clarity, the following description relates to only one of the injector sets. In the embodiments of the invention described below, the fuel injectors 12*a*, 12*b* are of a negative-charge displacement type. The fuel injectors 12*a*, 12*b* are therefore opened to inject fuel into the engine cylinder during a discharge phase and closed to terminate injection of fuel during a charging phase.

The engine 8 is controlled by an Engine Control Unit (ECU) 14, of which the drive circuit 20*a* forms an integral part. In addition, the ECU 14 may advantageously include a microprocessor and a memory (not indicated), which are arranged to perform various routines to control the operation of the engine 8, including the control of the fuel injector arrangement, for example, using an injector control unit 21 (ICU) as shown. The ECU 14 may continuously monitor a plurality of engine parameters 23 (such as engine speed and load), and then feed an engine power requirement signal to the ICU 21. The ICU 21 calculates a demanded injection event sequence to provide the required power for the engine and controls the injector drive circuit 20*a* of the ECU 14 accordingly. In turn, the drive circuit 20*a* causes a current to be applied to or removed from the injectors to achieve the demanded injection event sequence.

The ECU 14 is connected to an engine battery (not shown) which has battery voltage $V_{BAT}$ of about 12 V. The ECU 14 generates the voltages required by other components of the engine 8 from the battery voltage $V_{BAT}$.

Further details of the operation of the ECU 14 and its functionality in operating the engine 8, particularly the injection cycles of the injector arrangement, are described in WO 2005/028836. Signals may be transmitted between the microprocessor (not shown) of the ECU 14 and the drive circuit 20*a* and data, comprised in the signals received from the drive circuit 20*a* may be recorded in the memory (not shown) of the EUC 14.

To control a sequence of fuel injection events, the drive circuit 20*a* may be considered to operate in three main phases: a discharge phase, a charge phase and a regeneration phase. During the discharge phase, the drive circuit 20*a* operates to discharge one or more of the fuel injector 12*a*, 12*b* to lift the injector valve needle 13 from the valve seat 7 to inject fuel. Typically, the injection event includes a dwell period immediately following the discharge phase, during which there is substantially no overall current flow either to or from the piezoelectric actuator. Thus, during the dwell period, the actuator remains in its discharged and contracted state, and fuel injection into an associated engine cylinder continues. The fuel injection phase is terminated by a charge phase. During the charge phase, the drive circuit 20*a* operates to charge the previously discharged fuel injector 12*a*, 12*b* to close the injector valve and, thus, terminate the injection of fuel. During the regeneration phase, energy in the form of electrical charge may be replenished to a first storage capacitor C1 and a second storage capacitor C2 (not shown in FIG. 1), for use in subsequent injection cycles, so that a dedicated power supply may not be required. Each of these phases of operation will be described in further detail below, with reference to a suitable drive circuit as depicted in FIG. 2.

Figure 2:
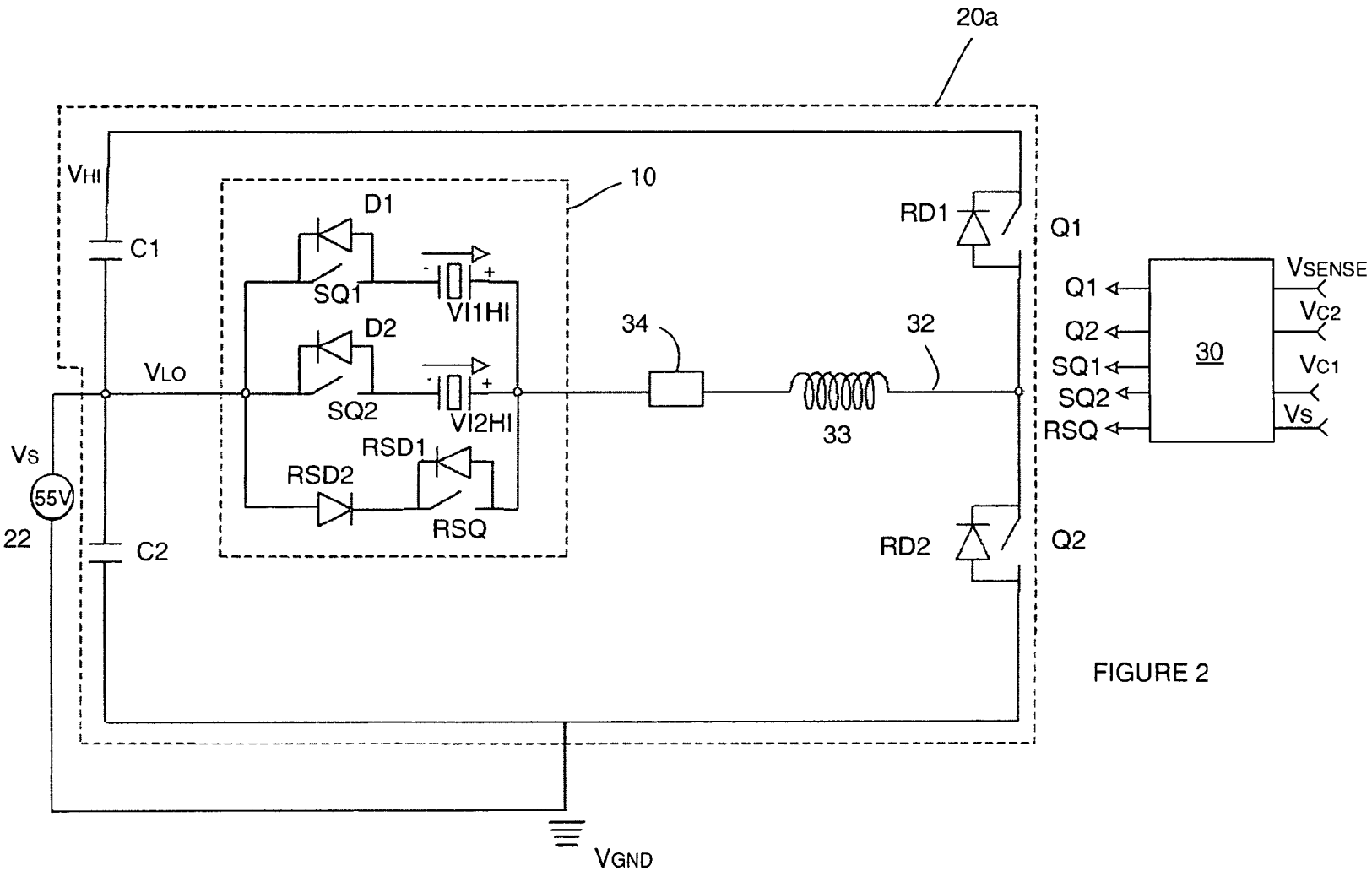
FIG. 2 is a circuit diagram illustrating the drive circuit in FIG. 1.

Referring to FIG. 2, the drive circuit 20*a* comprises a first, high voltage rail $V_{HI}$ and a second, low voltage rail $V_{LO}$. The first voltage rail $V_{HI}$ is at a higher voltage than the second voltage rail $V_{LO}$. The drive circuit 20*a* also includes a half-H-bridge circuit having a middle current path 32 which serves as a bi-directional current path. The middle current path 32 has an inductor 33 coupled in series with the injector set 10 of fuel injectors 12*a*, 12*b*. The fuel injectors 12*a*, 12*b* and their associated switching circuitry are connected in parallel with each other.

Each fuel injector 12*a*, 12*b* has the electrical characteristics of a capacitor, with its piezoelectric actuator 11 being chargeable to hold voltage which is the potential difference between a low side (−) terminal and a high side (+) terminal of the piezoelectric actuator 11.

The drive circuit 20*a* further comprises a first storage capacitor C1 and a second storage capacitor C2. Each of the storage capacitors C1, C2 has a positive and a negative terminal. Further, each storage capacitor C1, C2 has a high side and a low side; the high side is on the positive terminal of the capacitor and the low side is on the negative terminal. The first storage capacitor C1 is connected between the high voltage rail $V_{HI}$ and the low voltage rail $V_{LO}$. The second storage capacitor C2 is connected between the low voltage rail $V_{LO}$ and the ground potential rail $V_{GND}$.

In addition, as the drive circuit 20*a* has a voltage source $V_S$, or power supply, 22 supplied by the ECM 14, the drive circuit 20*a* does not have a dedicated power supply. The voltage source $V_S$ is connected between the low voltage rail $V_{LO}$ and the ground potential rail $V_{GND}$, and is arranged to supply energy to the second storage capacitor C2. Energy is supplied to the first storage capacitor C1 by regeneration of charge to it during the regeneration phase. Typically the voltage source $V_S$ is between 50 and 60 V, such as 55 V.

In the drive circuit 20*a* there is a charge switch Q1 and a discharge switch Q2 for controlling, respectively, the charging and discharging operations of the first and second fuel injectors 12*a*, 12*b*. The charge and the discharge switches Q1, Q2 are operable, for example, by a microprocessor (not shown) of the ECU 14. Each of the charge and the discharge switches Q1, Q2, when closed, allows for unidirectional current flow through the respective one of the switches and, when open, prevents current flow. The charge switch Q1 has a first recirculation diode RD1 connected across it. Likewise, the discharge switch Q2 has a second recirculation diode RD2 connected across it. These recirculation diodes RD1, RD2 permit recirculation current to return charge to the first storage capacitor C1 and the second storage capacitor C2, respectively, during an energy recirculation phase of operation of the drive circuit 20*a*, in which energy is recovered from at least one of the fuel injectors 12*a*, 12*b*.

The first fuel injector 12*a* is connected in series with an associated first selector switch SQ1, and the second fuel injector 12*b* is connected in series with an associated second selector switch SQ2. Again, each of the selector switches SQ1, SQ2 may be operable by a microprocessor (not shown). A first diode D1 is connected in parallel with the first selector switch SQ1, and a second diode D2 is connected in parallel with the second selector switch SQ2. By way of example, a discharge current ($I_{DISCHARGE}$) is permitted to flow in a discharge direction through the selected fuel injector 12*a* when its associated selector switch SQ1 is activated and the discharge switch Q2 is operated. The first and second diodes D1, D2 each allow a charge current ($I_{CHARGE}$) to flow in a charge direction during the charging phase of operation of the circuit, across the first and the second fuel injectors 12*a*, 12*b*, respectively.

A regeneration switch circuitry is included in the drive circuit 20*a* in parallel with the injectors 12*a*, 12*b* to implement the regeneration phase. The regeneration switch circuitry serves to connect the second storage capacitor C2 to the inductor 33. The regeneration switch circuitry comprises a regeneration switch RSQ which is operable by a microprocessor (not shown). A first regeneration switch diode RSD1 is connected in parallel with the regeneration switch RSQ, and a second regeneration switch diode RSD2 is coupled in series to the first regeneration switch diode RSD1 and the regeneration switch RSQ. The second regeneration switch diode RSD2 acts as a protection diode, because the first and second regeneration switch diodes RSD1, RSD2 are opposed to each other, so that current will not flow through the regeneration switch circuitry unless the regeneration switch RSQ is closed and current is flowing from the second voltage rail $V_{LO}$. Current, thus, cannot pass through the regeneration switch circuitry during the charging phase.

The middle current path 32 includes a current sensing and control means 34 that may be arranged to communicate with a microprocessor (not shown). The current sensing and control means 34 is arranged to sense the current in the middle current path 32 and to compare the sensed current with a predetermined current threshold. The current sensing and control means 34 generates an output signal when the sensed current is substantially equal to the predetermined current threshold.

A voltage sensing means (not shown) is also provided to sense the sensed voltage $V_{SENSE}$ across the fuel injector(s) 12*a*, 12*b* selected for injection. The voltage sensing means is used to sense the voltages $V_{C1}$, $V_{C2}$ across the first and second storage capacitors C1, C2, and the power supply 22. The regeneration phase is terminated when sensed voltage levels $V_{C1}$, $V_{C2}$ across the first and second storage capacitors C1, C2 are substantially the same as the predetermined voltage levels.

The drive circuit 20*a* also includes control logic 30 for receiving the output of the current sensing and control means 34, the sensed voltage, $V_{SENSE}$, from the positive terminal (+) of the actuators 11 of the fuel injectors 12*a* and 12*b*, and the various output signals from any microprocessor (not shown) and its associated memory (also not shown). The control logic 30 includes software executable by a microprocessor for processing the various inputs so as to generate control signals for each of the charge and the discharge switches Q1, Q2; the first and second selector switches SQ1, SQ2; and the regeneration switch RSQ. By controlling the injector select switches SQ1, SQ2, the charge switch Q1, and the discharge switch Q2, it is possible to drive a varying current through the injectors 12*a*, 12*b*, for a required time period, such that the actuator of a selected injector is charged or discharged, and fuel delivery is controlled accordingly. It will be appreciated that although the injector drive circuit 20*a* is shown in FIG. 1A as forming an integral part of the ECU 14, this need not be the case and the injector drive circuit 20*a* may be a separate unit from the ECU 14.

In general, during a fuel injection event sequence having a single, main injection of fuel from the first injector 12*a*, the associated drive circuit 20*a* may be operated in the following manner.

The drive circuit 20*a* delivers a drive pulse (or voltage waveform) to the piezoelectric actuator 11 of the fuel injector 12*a* (or 12*b*, as desired). The drive pulse varies the differential voltage across the piezoelectric stack 9 of the actuator 11 between the charge voltage, $V_0$ (or the first differential voltage level), and the discharge voltage, $V_1$ (or the second differential voltage level).

When in a non-injecting state the first injector select switch SQ1 is open and both the charge and discharge select switches Q1, Q2 are open. During this stage of operation the differential voltage across the terminals of the actuator 11 is at a first differential voltage level (or $V_0$), which may be approximately 200 V. However, in accordance with the invention, it is desirable to make $V_0$ as low as possible for as long as possible during the operation of the piezoelectric actuator 11. Thus, without being limited to the specific apparatus described in relation to FIGS. 1 and 2, in one embodiment the method of the invention aims to adjust $V_0$ to a minimum suitable voltage level (i.e. the third differential voltage level, $V_3$) for as long a duration of the energised (or charged) state of the actuator 11 as possible. For example, $V_0$ of the third differential voltage level is advantageously less than 200 V, such as between 200 and 150 V or between 200 and 100 V. Advantageously, $V_0$ is less than 180 V (for example, between 180 and 150 V or between 180 and 100 V); or more advantageously less than 160 V, such as approximately 150 V. Beneficially, the third differential voltage level is maintained for at least 20%, at least 40% or at least 50% of the operating period of the piezoelectric actuator. In some advantageous embodiments, the third differential voltage level is maintained for at least 75% or at least 90% of the operating period of the piezoelectric actuator.

In order to cause the first injector 12*a* to deliver fuel, the first injector select switch SQ1 is activated (i.e. closed) and the injector discharge select switch Q2 is activated (i.e. closed). This causes charge to flow out of the injector 12*a*, through the inductor 34 and the discharge select switch Q2 to the ground potential rail GND. The injector drive circuit 20*a* determines, from a look-up table stored in a memory of the ECU 14, for example, a demanded discharge period or time for which the discharge current $I_{DISCHARGE}$ is transferred from the actuator 11 to ground GND. This may be referred to as the discharge phase (T0 to T1). Once the discharge time has elapsed, the injector discharge switch SQ1 is deactivated (i.e. opened) to terminate charge transfer. As a result of the charge transfer, the differential voltage across the injector 12*a* is decreased to a relatively low, second differential voltage level ($V_1$). Typically, the value of $V_1$ is selected from a look-up table stored in a memory of the ECU 14 (or similar means of data manipulation), on the basis of the known energised differential voltage ($V_0$), such that the voltage drop from $V_0$ to $V_1$ is sufficient to cause a required response (i.e. a known length of contraction) in the piezoelectric stack 9 of the actuator 11 to initiate the desired fuel injection event. Again, without being limited by the specific apparatus described in relation to FIGS. 1 and 2, in one embodiment the method of the invention aims to maintain $V_0$ at a minimum suitable voltage level irrespective of the consequential effect on the level of $V_1$ that may be reached when the required voltage drop across the actuator is implemented in order to cause the desired contraction of the piezoelectric stack and, hence, the desired amount of fuel injection. Typically, the second differential voltage level (or $V_1$) is between −50 and +50 V, such as in the range of −50 V to 0 V, or suitably in the range of −30 and 0 V. In some embodiments, however, it may be beneficial to substantially maintain $V_1$ in the range of 0 V to +50 V (such that, in use, the majority of discharge phases do not cause $V_1$ to drop below 0 V or at least not below approximately −10 V). Thus, it is envisaged that the method of the invention may further operate to maintain $V_0$ at a minimum appropriate level, which will allow $V_1$ to be substantially maintained at approximately 0 V and above; for example, in the range of 0 to 50 V. In this embodiment, in use, $V_0$ may be higher than in the previously described embodiment, particularly during a main injection event, wherein in the previous embodiment, $V_1$ may frequently fall below 0 V.

The differential voltage across the actuator will normally remain, or "dwell", at the second differential voltage level for a relatively brief period during which the injector is injecting fuel. This dwell period is conveniently selected according to engine fuel demand, for example, from a look-up table stored in a memory of the ECU 14 on the basis of one or more engine parameters, such as engine speed and load.

In order to terminate an injection event, the injector charge switch Q1 is activated to cause charge to flow from the high voltage rail $V_{HI}$, through the charge select switch Q1 and into the injector 12*a*, thus re-establishing a differential voltage of e.g. about +200 V across the terminals of the injector 12*a*. This is referred to as the charge phase (T2 to T3). In accordance with the invention, the new voltage across the actuator 11 once the injection event has terminated is the third differential voltage level, $V_3$ or $V_3$ as described elsewhere herein. The time and frequency with which the injector charge switch Q1 is activated during the charge phase may be based on the discharge time of the preceding discharge phase and the selected energised state or third differential voltage level of the actuator 11.

As already discussed, advantageously, the charged differential voltage level of the actuator (or $V_3$) following a discharge event is lower than the charged differential voltage level (or $V_0$) preceding that discharge event. It should be appreciated, however, that in some circumstances, the third differential voltage level may be higher than the first differential voltage level, for example, when the ECU 14 has determined that a subsequent fuel injection event requires a larger voltage drop across the actuator than a preceding injection event, such as in response to an increase in engine demand. Thus, where the ECU 14 has selected a third differential voltage level of, for example, 170 V and the preceding charged voltage level was 150 V, then the third differential voltage level will be higher than the first differential voltage level. Of course, in some cases; for example, during periods of relatively constant fuel demand, the third differential voltage level may be approximately the same as the first differential voltage level.

Finally, there may be a regeneration phase to regenerate the charge across the storage capacitor C1. During the regeneration phase, the regeneration switch RSQ and the discharge switch Q2 are each activated, until the energy on the first storage capacitor C1 reaches a predetermined level.

Various modes of operation of the drive circuit 20*a* in the charging and discharge phases, and the regeneration phase, are described in detail in WO 2005/028836A1, which is incorporated herein by reference.

Advantageously, during the discharge phase (T0 to T1), the discharge switch Q2 is automatically opened and closed under the control of a signal that may be emitted by a microprocessor (not shown) of the ECU 14, until the appropriate amount of charge has been removed from the piezoelectric actuator in order that the differential voltage across the selected fuel injector 12*a* is reduced to the appropriate discharged level ($V_1$) to initiate an injection event. Then, after the predetermined time during which injection is required (the dwell period), the fuel injector 12*a* is closed by closing the charge switch Q1. Typically, during the subsequent charge phase (T2 to T3; T2 to T3'), the charge switch Q1 is continually opened and closed until the appropriate amount of charge is added to the piezoelectric actuator to achieve the new energised or charged differential voltage ($V_3$). Accordingly, the charge and discharge currents are suitably controlled at a desired level. Similarly, during a regeneration phase, the discharge switch Q2 is periodically opened and closed until the charge on the first storage capacitor C1 reaches a predetermined level to establish the desired voltage of the high voltage rail, $V_{HI}$.

Figure 3:
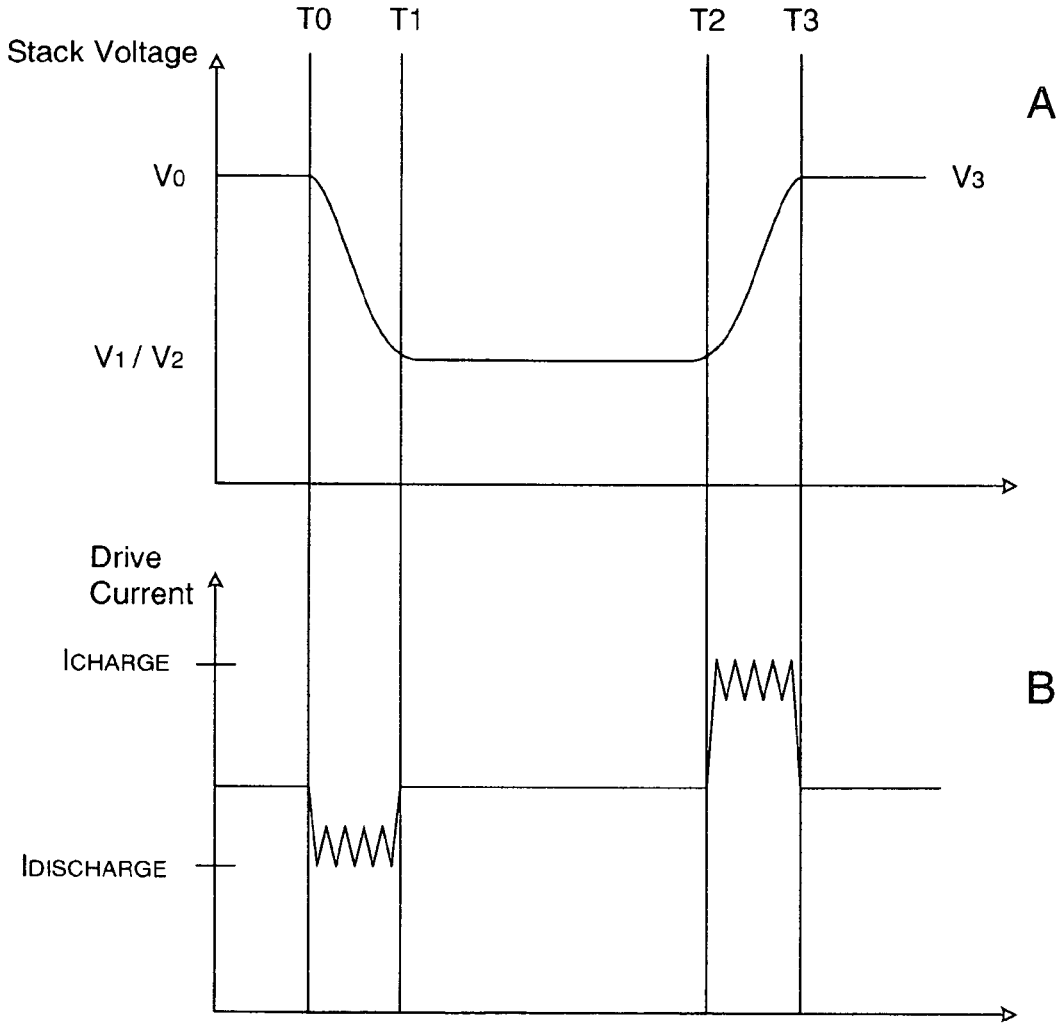
FIG. 3 illustrates: (A) a voltage profile for an injection event sequence for implementation by the injector drive circuit in FIG. 2; and (B) an idealised drive current profile corresponding to the voltage profile in FIG. 3A.

FIG. 3A represents the voltage profile of a typically injection event comprising a single injection of fuel, as described above, and FIG. 3B represents the drive current profile corresponding to the voltage profile in FIG. 3A. At time T0 a discharge phase is initiated by driving an amplitude modulated discharge current, at RMS current level $I_{DISCHARGE}$, through the injector for the time period T0 to T1. The discharge current is turned off at the end of the discharge phase, i.e. at time T1, and the injector remains in the dwell phase until time T2. Between time T1 and time T2 the injector is injecting fuel. The differential voltage across the actuator 11 at time T2 may be referred to as $V_2$. Typically, $V_2$ is the same as $V_1$, and for the purposes of this description, it is assumed that $V_2$ is the same as $V_1$. However, it is possible that in some embodiments the differential voltage level $V_2$ may be slightly different to $V_1$: such embodiments are also comprised within the scope of the invention described herein. In this case, the second differential voltage level of step (a) is considered to be $V_1$, and the second differential voltage level of step (d) is considered to be $V_2$. The "maintaining of the second differential voltage" in step (b) is typically to be read as "substantially maintaining the second differential voltage". At time T2 an amplitude modulated charge current at RMS current level $I_{CHARGE}$, is supplied to the injector for a charge phase until time T3 when the charge current $I_{CHARGE}$ is turned off and the injector is returned to its non-injecting state at differential voltage level $V_3$ (or $V_0$).

It will be appreciated that because the injector spends the majority of its service life in a non-injecting state, it spends the majority of its operational life with a high differential voltage ($V_0$; $V_3$; $V_{3'}$) across the actuator terminals. As discussed previously, this can be prejudicial to measures of injector performance, such as durability.

The method of the invention may be implemented by the drive circuit in FIGS. 1 and 2 to improve/increase the life span of a piezoelectric fuel injector by recognising that, in certain circumstances, the differential voltage across the actuator terminals need not be always be returned to the same high differential voltage level ($V_0$) of the initial, non-injecting state at the end of the charging phase (T2 to T3'). One mode of implementing this advantageous method of the invention is described in relation to FIG. 4.

Figure 4:
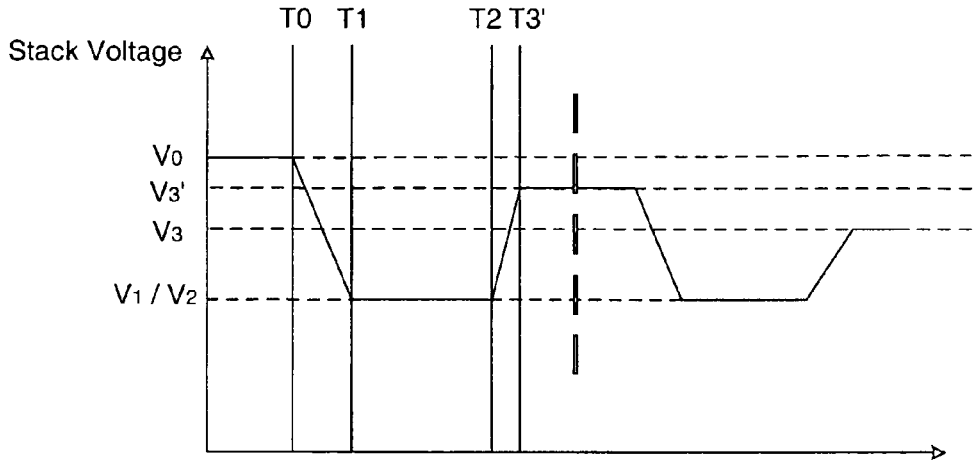
FIG. 4 is a voltage profile for an injection event sequence in accordance with an embodiment of the invention.

As depicted in FIG. 4, initially at time T0 the injector is in a non-injecting state in which the differential voltage across the actuator (the first differential voltage level, $V_0$) may be around +200 V. At this time, at least two engine parameters selected from: (i) the pressure of fuel in the common rail (rail pressure); (ii) the predetermined on-time ($T_{on}$) of the subsequent fuel injection event; and (iii) the piezoelectric stack temperature may be determined. By way of example, fuel pressure may be conveniently determined from a rail pressure sensor signal provided to the ECU 14. $T_{on}$ may be selected from a look-up table (or similar) stored in the ECU 14 and determined from the engine's fuel demand based on one or more engine parameters, such as the average or more suitably, the instantaneous engine speed and load. The piezoelectric stack temperature may be calculated or estimated using the methods described in detail in our co-pending application, EP 1811164, which is briefly described below.

To initiate a fuel injection event, between time T0 and T1 (as previously described), a discharge current $I_{DISCHARGE}$ flows from the actuator in order to remove the demanded amount of charge (the "opening discharge") from the actuator, thereby reducing the differential voltage across the actuator to a relatively low voltage level required for the fuel injection event, which may be around −30 V. The differential voltage may be reduced to as much as −50V or, for smaller values of needle lift, may be reduced to between 0 and +50 V, such as around 0 V. In some embodiments the discharge current $I_{DISCHARGE}$ may be selected on the basis of one or more engine parameters (as described below). For example, $I_{DISCHARGE}$ may be determined by one or more of rail pressure (P), piezoelectric stack temperature and/or the first differential voltage level. In one embodiment, $I_{DISCHARGE}$ is determined as a function of rail pressure, piezoelectric stack temperature and the first differential voltage level, as described below.

At the end of the discharge phase, at time T1, the discharge current $I_{DISCHARGE}$ is removed and the actuator remains in the dwell phase until time T2. Between time T1 and time T2 the injector is injecting fuel. The period between T0 and T2 is termed the on time of the fuel injection event or $T_{on}$.

Beneficially, before or during the period from T0 to T2 (for example, during the discharge phase or during the dwell phase), the ECU 14 may be programmed to determine to what differential voltage level (the third differential voltage level) the actuator should be recharged to terminate the injection event. This third differential voltage level ($V_3$) is conveniently determined using one or more look-up tables, scale functions, equations or similar, based on two or more of the engine parameters including: rail pressure, $T_{on}$ and piezoelectric stack temperature as discussed above. Advantageously, the determination is based on a combination of all three of rail pressure, $T_{on}$ and piezoelectric stack temperature. For instance, if the rail pressure measured at the start of the injection event is below a predetermined level (e.g. 500 bar), the ECU 14 may determine that it is not necessary to re-establish the initial, relatively high differential voltage across the actuator 11 at the end of the charge phase (T2 to T3; T2 to T3'). However, this decision may also be dependent on the predetermined value of $T_{on}$ for the impending, subsequent fuel injection event and/or the piezoelectric stack temperature. Likewise, if $T_{on}$ for the impending injection event is smaller than (or approximately the same as) $T_{on}$ for the preceding injection event, or alternatively, that $T_{on}$ for the impending injection event is below a predetermined value (such as 500 μs), the ECU 14 may determine that the actuator 11 can suitably be recharged to a third differential voltage level that is lower than the previous energised differential voltage level ($V_0$). Similarly, if the ECU 14 determines that the temperature of the piezoelectric stack is above a predetermined value (or alternatively, that the temperature of the piezoelectric stack has increased over the period between successive measurements), then the ECU 14 may determine that the actuator 11 should be recharged to a lower third differential voltage level than the preceding first differential voltage. In one embodiment, therefore, each of the measured or estimated values for rail pressure, $T_{on}$ and the temperature of the piezoelectric stack are conveniently compared to a predetermined value for that parameter, in order for the ECU 14 to determine whether the third differential voltage level should be higher than, the same as, or lower than the first differential voltage level. Thus, individually: (a) a lower rail pressure than a predetermined value typically results in a signal from the ECU 14 to lower the energised differential voltage level of the actuator 11; (b) a shorter $T_{on}$ than a predetermined value typically results in a signal from the ECU 14 to lower the energised differential voltage level of the actuator 11; and (c) a higher piezoelectric stack temperature than a predetermined value typically results in a signal from the ECU 14 to lower the energised differential voltage level of the actuator 11.

In a more advantageous embodiment, wherein the third differential voltage level is determined in dependence on all three of the parameters: rail pressure, $T_{on}$ and piezoelectric stack temperature; the third differential voltage level may be determined by the ECU 14 on the balance of the values of those parameters. In some embodiments further engine parameters may also be measured and compared with predetermined parameter values to provide the final determination of the third differential voltage level that is required across the actuator 11 in view of that combination of measured or estimated engine parameters.

In such methods, the energised differential voltage across a piezoelectric actuator of a fuel injector may be varied in a step-change manner through an appropriate adjustment of the charging time, or conveniently by allowing the voltage of the high voltage rail ($V_{HI}$) to drop over successive fuel injection events. The amount of the step may be dependent on the amount by which the determined parameter differs from the predetermined value, on the balance of the various parameters considered; or, in a passive mechanism for reducing the third differential voltage, on the amount by which the top rail voltage ($V_{HI}$) can be reduced with each fuel injection event. Thus, in some embodiments, the target third differential voltage level may be achieved over a number of sequential fuel injection events (for example in a passive mechanism, as indicated by the injection event following time T3' in FIG. 4); or the third differential voltage level may be selectively reduced over a number of successive fuel injection events depending on prevailing engine parameters.

In such embodiments, the ECU 14 conveniently controls the voltage of the high voltage rail ($V_{HI}$), having regard to the voltage of the low voltage rail ($V_{LO}$), in response to the measured or estimated engine parameters. In this way, the energised differential voltage across the piezoelectric actuator of an injector is varied by recharging the actuator to the voltage of the high voltage rail. The voltage of the high voltage rail is suitably calculated (in dependence on the engine parameters discussed above) to equal the sum of the third differential voltage level ($V_3$) required across the actuator and the voltage of the low voltage (or bottom) rail ($V_{LO}$). That is, the energised differential voltage across the actuator is the difference between the voltages of its respective terminals. Therefore, as discussed above in relation to the third differential voltage level, the voltage ($V_{HI}$) of the high voltage rail may be conveniently adjusted in a step-wise manner according to whether the relevant engine parameters (e.g. rail pressure, $T_{on}$ and piezoelectric stack temperature) are each above or below a predetermined value; or, more advantageously, in a linear manner in dependence on the absolute values of each of the relevant parameters. In these embodiments, the ECU 14 may perform the task of monitoring the two or more engine parameters and configuring the value of the high voltage rail as outlined below.

In this regard, our co-pending European patent application EP 1860306 describes a method in which the voltage of the high voltage rail ($V_{HI}$) is controlled through use of a regeneration switch circuitry (see FIG. 2) forming part of the drive circuit 20*a*. As described with respect to FIG. 2, the drive circuit 20*a* advantageously comprises a regeneration switch circuitry including a regeneration switch RSQ which is operable by the ECU 14 to vary the charge that is returned to the first storage capacitor C1 during a regeneration phase which occurs at the end of an injection event. The charge on the first storage capacitor C1 determines the level of the high voltage rail, $V_{HI}$. Therefore, one way of adjusting the level of the high voltage rail $V_{HI}$ in accordance with the present invention is to adjust the time for which the regeneration switch RSQ is operated in order to re-charge the storage capacitor C1 and, hence, to set the voltage of the high voltage rail $V_{HI}$. In an advantageous embodiment, the regeneration switch RSQ is not activated after a fuel injection event, to prevent the regeneration of the top rail and, thereby, allow the voltage of the top rail to reduce in a stepwise manner. The ECU 14 controls the operation of the regeneration switch RSQ, and thus the voltage of the top rail having regard to two or more engine parameters, selected from fuel pressure in the fuel rail (rail pressure); the electric pulse time ($T_{on}$); and the piezoelectric stack temperature. More suitably, the method selects the voltage of the top rail (and hence, indirectly the third differential voltage level) in dependence on at least rail pressure, $T_{on}$, and piezoelectric stack temperature. The voltage of the top rail may be controlled is a step-wise manner, i.e. as a result of a comparison with predetermined values for each of the relevant engine parameters; or more advantageously, the voltage of the high voltage rail ($V_{HI}$) may be varied linearly in proportion to each of the measured engine parameters.

Rather than the above passive mechanism for reducing the top rail voltage and, accordingly, the third differential voltage, a drive circuit 20*a* or alternative circuit may be adapted to actively reduce the voltage of the top rail.

In the above mechanisms, the piezoelectric actuator 11 is typically recharged to the level of the top rail. However, in an alternative embodiment of the invention, rather than the ECU 14 determining (e.g. from a look-up table or data map) the appropriate voltage required in the top rail to achieve the third differential voltage across the actuator 11 and adjusting the voltage of the top rail accordingly; the ECU 14 may instead (or in addition), determine the re-charging time necessary to add the required amount of charge to the piezoelectric actuator 11 to result in the selected third differential voltage level. This can be considered to represent an active mechanism for reducing the third differential voltage level. Where it has been determined that the actuator is to be recharged to a lower differential voltage level than the first differential voltage level, the charge current ($I_{CHARGE}$) is supplied to the actuator for a reduced time period (T2 to T3'), so that the differential voltage across the actuator at the end of the charge phase (i.e. at the end of injection at T3') is lower than the differential voltage immediately before the start of the discharge phase (i.e. at T0). This system represents an open loop charge control strategy, wherein the charge current is applied for the selected charging time in order to achieve a predetermined differential voltage. In an open loop system, as the charge current is not controlled on voltage, at the end of the charge phase further current pulses may be applied to the actuator to correct the third differential voltage level, if necessary. Apart from the charging time, T2 to T3', the ECU 14 may also select the charge current ($I_{CHARGE}$) in dependence on one or more engine parameters, as described with respect to the selection of the appropriate discharge current ($I_{DISCHARGE}$) at T0.

In contrast, if prior to a fuel injection event it is determined that relevant engine parameters have changed, for example, rail pressure may have increased above the predetermined threshold, a higher differential voltage level may be required across the actuator. In this case, the charge current ($I_{CHARGE}$) may be applied to the actuator, under the control of the ECU 14, for an increased time period (e.g. T2 to T3 in FIG. 3A), so as to establish a higher voltage (such as the first differential voltage level, $V_0$) across the actuator 11 at the end of the charge phase. It will be appreciated that in some circumstances the actuator may be re-charged to a higher differential voltage level than the first differential voltage level, $V_0$. This is particularly likely when the method of the invention is used over a plurality of fuel injection events (as is typically the case), because the first differential voltage level may have been significantly reduced during preceding fuel injection events.

As in the passive mechanism discussed above, the charge time of the piezoelectric actuator (T2 to T3; T2 to T3') may be selected to adjust the third differential voltage in a stepwise manner based on comparisons between measured and predetermined engine parameter values; or it may be selected in a linear manner as a function of the two or more engine parameters; rail pressure, $T_{on}$ and piezoelectric stack temperature. In the linear method, the ECU 14 takes account of the relative change in each of the measured (or estimated) parameter values from one injection event to the next. Thus, if rail pressure is decreased for a second injection event compared to that during the previous injection event (for simplicity, assuming that all other relevant engine parameters are unchanged), the injector is controlled so that the differential voltage across the injector at the end of the charging phase is reduced in proportion to the decrease in rail pressure: for example, by adjusting the charge time (T2 to T3, T2 to T3') appropriately. As described previously, the ECU 14 may select an appropriate reduced charge time from data stored in its memory by first determining (e.g. from a look-up table or data map) the differential voltage that is required across the injector having regard to the measured or estimated one or more engine parameters. The ECU 14 then determines (from a look-up table or data map) the appropriate charge time that will result in the desired differential voltage level.

It can be advantageous to use a linear method for selecting the third differential voltage level, particularly in an active mechanism for adjusting the third differential voltage level, because any changes in the energised differential voltage level of the piezoelectric actuator can be readily controlled in a linear manner.

Advantageously, the ECU 14 performs the task of monitoring the rail pressure and other engine parameters and selecting the differential voltage across the injector, and hence either the voltage of the top rail, or the charge time, or both, depending on those engine parameters. Purely by way of example, the required differential voltage level of a piezoelectric actuator 11 of a fuel injector in its non-injecting state (T3 to T0), and the required differential voltage drop ($V_0$ to $V_1$) to initiate the required fuel injection event can be significantly affected by a change in rail pressure in the following manner. At full rail pressure a differential voltage of +200 V may typically be applied across the terminals of the actuator 11 when the injector is in its non-injecting state; and the differential voltage may be reduced to e.g. −30 V (i.e. a differential voltage drop of 230 V) to initiate a main injection. However, at the lowest rail pressure, it may be possible to carry out a main injection event when the differential voltage across the actuator terminals is about +180 V or less in the injectors non-injecting state, and with a differential voltage drop of approximately only 180 to 200 V to initiate the fuel injection event. In addition to the affect of engine parameters, the optimum differential voltage levels may also be dependent upon, for example, the injector design and the nature of the piezoelectric actuator.

Thus, a benefit of the invention is that the piezoelectric actuator spends a reduced period of time with the highest differential voltages across the actuator terminals (e.g. 200 V and above) and, therefore, the actuator is subjected to a reduced stress during operation. Since a de-energise to inject fuel injector is in its non-injecting state for the major part of the time in which a is in use (and thus, under known modes of operation, at its highest differential voltage level), by reducing the differential voltage of the actuator in the non-injecting state, the expected operational lifespan of the actuator may be significantly improved.

Furthermore, it should be appreciated that when the engine has a low demand for fuel, such as during a period when it is at idle, only a small amount of injected fuel is necessary to keep the engine ticking over. To inject a small quantity of fuel, the fuel injector need not open to a large extent and, hence, it is only necessary to remove a small amount of charge from the piezoelectric actuator. It is possible to remove this small amount of charge from the piezoelectric actuator even when it initially has a relatively small amount of charge on it, such as when the differential voltage across the actuator is relatively low (such as 100 V). Thus, if rail pressure is relatively low, only a small valve needle lift is required for fuel injection and so the absolute charge level on the piezoelectric actuator is not normally critical to injector operation. In these circumstances the piezoelectric actuator can readily be recharged to a lower energised differential voltage and subsequently discharged by a relatively small opening discharge, without compromising injector performance.

In one embodiment, the ECU 14 determines the third differential voltage level of the actuator in dependence on at least rail pressure and $T_{on}$ in a linear manner. For instance, the ECU 14 may use a predetermined data map relating rail pressure and $T_{on}$ to select an appropriate third differential voltage level to which to recharge the actuator at the end of a fuel injection event. Alternatively, a look-up table, equation or scale function may be stored in the ECU 14 and used to determine the appropriate desired voltage level of the high voltage rail ($V_{HI}$) having regard to the voltage of the low voltage rail ($V_{LO}$). Advantageously, piezoelectric stack temperature is also measured (or estimated) and the third differential voltage level is determined also having regard to that value. In one embodiment, a data map of rail pressure and $T_{on}$ is used to obtain a first value for the third differential voltage level. In another embodiment, subsequent to determining the first value for the differential voltage level, a scale function based on piezoelectric stack temperature is applied to the first value to obtain a second value corresponding to the desired third differential voltage level or the desired voltage of the high voltage rail. It will be appreciated that the third differential voltage level may alternatively be determined on the basis of three separate scale functions based on rail pressure, $T_{on}$, and piezoelectric stack temperature (or any other relevant engine parameters); or using any other combination of data map or look-up table relating the three engine parameters of interest.

The method described previously utilises an open loop charge control strategy to achieve the third differential voltage. In another embodiment, a closed loop charge control strategy may be used whereby the charge on the actuator is measured repeatedly throughout the charge phase (T2 to T3, T2 to T3'), for example, by monitoring the voltage across the actuator to determine the charge level (i.e. using Q=C×V where Q=charge, C=capacitance and V=voltage). In such embodiments, the charge current is applied to the actuator until such time as the desired charge (corresponding to the selected third differential voltage level) is achieved.

In another variation, a closed loop voltage control strategy may be used whereby the voltage is measured throughout the charge phase and the charge current is terminated when it is determined that the selected third differential voltage level has been achieved across the actuator.

Figure 5:
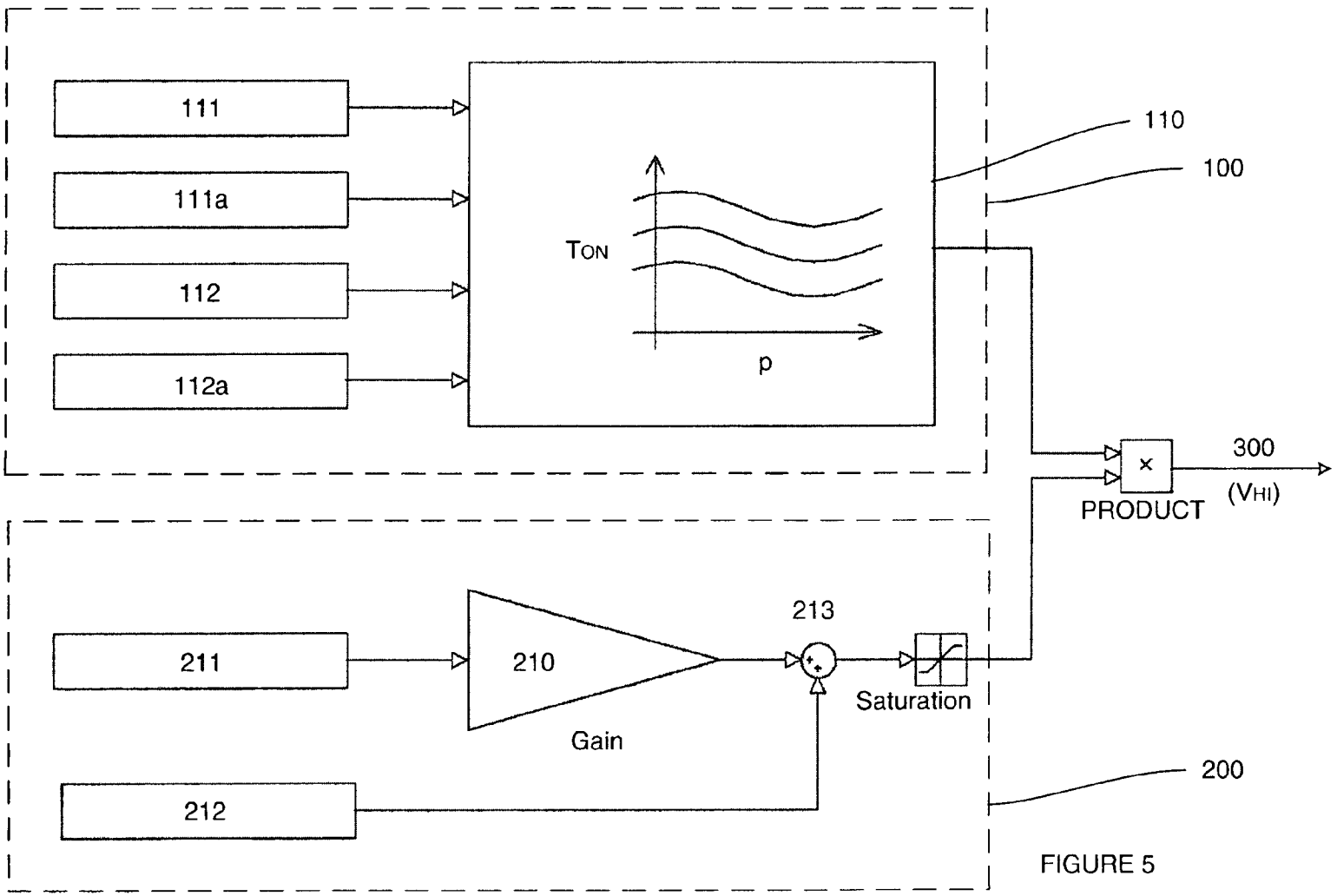
FIG. 5 is a control flow diagram to illustrate the steps that may be applied to calculate the voltage of a top rail of a drive circuit for a piezoelectric fuel injector in order to achieve a target third differential voltage level, in accordance with an embodiment of the invention.

A control flow diagram to illustrate the steps that may be taken to calculate the third differential voltage level ($V_3$) of a piezoelectric actuator, or to calculate the necessary top rail voltage ($V_{HI}$) of a drive circuit to result in the required third differential voltage level is illustrated in FIG. 5. In this embodiment, an ECU is used to determine the target top rail voltage 300 ($V_{HI}$) that is required to generate the target third differential voltage level across a piezoelectric actuator in a fuel injector. However, as previously discussed, in another embodiment, the third differential voltage may be controlled downstream of the voltage 300, for example, by selecting a charge time so that an actuator 11 is not fully charged to the voltage of the top rail.

The control flow diagram comprises two interacting sub-models; a first sub-model 100, which generates a 3-dimensional data map 110 relating rail pressure (P) to $T_{on}$; and a second sub-model 200, which generates a scale factor 210 which allows the top rail voltage to be adjusted according to piezoelectric stack temperature (Temp). The target top rail voltage ($V_{HI}$) 300 is the product of the output of the data map 110 and the scale factor adjustment due to piezoelectric stack temperature obtained from the second sub-model 200.

In the first sub-model 100, the data map 110 is defined by a scale of rail pressure values 111 (e.g. from 0 to 2000 bar) along an x-axis and a scale of $T_{on}$ values 112 (e.g. 0 to 2000 ms) along a y-axis. To determine the target top rail voltage, $V_{HI}$ (which will be used to charge the piezoelectric actuator to the third differential voltage level, $V_3$, for a particular fuel injection event), the measured rail pressure (P) 111*a* and the calculated $T_{on}$ 112*a* for the next fuel injection event are fed into the data map 110, and the z-axis provides the target top rail voltage $V_{HI}$ in dependence on those two values.

Conveniently, rail pressure 111*a* is determined using a pressure sensor arranged to measure fuel pressure in the common rail of an engine, although any suitable means may be used. The $T_{on}$ of the next fuel injection event (i.e. the length of a fuel injecting phase of a fuel injection event) can be calculated, for example, by an ECU 14 in a known manner based on engine demand (e.g. according to engine speed and load).

The value of the target top rail voltage obtained from the first sub-model is conveniently based on a default piezoelectric stack temperature ($Temp_{DEFAULT}$), which may be equivalent to, or an approximation of, the steady state temperature of a piezoelectric stack of an actuator 11 in use. In some embodiments (where the third differential voltage level of the piezoelectric actuator is selected only in dependence of rail pressure and $T_{on}$ and, therefore, it is assumed that the actuator 11 is at the default piezoelectric stack temperature), then the output (i.e. the z-axis reading) of sub-model 110 is taken as the target top rail voltage, $V_{HI}$.

An advantageous function of the second sub-model 200 is to limit the length of time during which the piezoelectric actuator is exposed to high differential voltage levels at undesirably high temperatures. That is, since a piezoelectric actuator may be under increased stress at higher temperatures, by reducing the energised differential voltage across a piezoelectric stack at those high temperatures, the lifespan or the piezoelectric actuator may be extended.

In the second sub-model 200, an estimate (or measurement) of piezoelectric stack temperature (Temp) 211 is taken using any appropriate means. For example, piezoelectric stack temperature may be measured directly by a temperature sensor where practical. Alternatively, piezoelectric stack temperature may be estimated by calculation, for example, using the methods described in the Applicant's granted European patent EP 1811164, all of which are incorporated herein and fall within the scope of the invention.

The methods described in EP 1811164 may be used to determine the steady state temperature of the stack (i.e. when the engine parameters have equalised under specific operating conditions), and also the dynamic temperature of the stack (i.e. when the engine operating parameters are not constant). The estimated steady state temperature of the piezoelectric stack may be used to estimate the dynamic temperature of the piezoelectric stack. Alternatively, the method may include estimating a dynamic temperature of the piezoelectric stack directly, rather than first calculating the steady state temperature.

Having determined the piezoelectric stack temperature (Temp) the determined value is compared to predetermined data on the effects of temperature on piezoelectric actuator lifespan and/or durability. The measured or estimated piezoelectric stack temperature 211 is subjected to a gain factor 210, which reflects the effect of temperature on e.g. the lifespan of the actuator, or the relative stress that the actuator is under. A scale offset 212 is added to the product of the measured or estimated temperature 212 and the gain factor 210 to generate a numerical factor by which the determined energised differential voltage across the piezoelectric stack obtained from data map 110 should be adjusted in dependence on stack temperature. The sum of: (i) the scale offset 212; and (ii) the product of the piezoelectric stack temperature 211 and gain 210 outputs a linear relationship between piezoelectric stack temperature and the target differential voltage level. However, this value is suitably moderated using a saturation function 213, to account for portions of non-linearity between temperature 211 and adverse effects on piezoelectric actuator stress or lifespan, and to ensure that any resultant target top rail voltages obtained are kept within acceptable limits. For example, the sub-model 200 (i.e. the sum of the scale factor or gain 210 and the scale offset 212) may be calibrated to 1 (by virtue of the saturation function 213), such that no further change in the target top rail voltage obtained from data map 110 is caused when the piezoelectric stack is within an acceptable (or desirable) operating temperature range (for example, at a temperature of 100° C. or less, such as between 10° C. and 100° C.). In contrast, where the temperature of the piezoelectric stack is determined to be above a desirable level (e.g. above 100° C.), the sum of the scale factor or gain 210 and the scale offset 212 may be less than 1, such that the target top rail voltage (and third differential voltage level) is reduced, until the lower limit of the saturation function 213 is reached, at which point no further reduction in the target top rail voltage 300 can be allowed, to prevent any adverse affects on engine performance.

In some embodiments, the top rail voltage, $V_{HI}$, may be determined on the basis of rail pressure and piezoelectric stack temperature. In this case, the model depicted in FIG. 5 may be adjusted to include a data map relating the target top rail voltage to rail pressure and piezoelectric stack temperature. A second sub-model comprising a linear scale factor may then be used to adjust the target top rail voltage 300 according to another engine parameter, such as $T_{on}$. Alternatively, the measured or estimated piezoelectric stack temperature may be used in a second data map in combination with the output of the first data map 110 to derive a target third differential voltage level ($V_3$) or high rail voltage ($V_{HI}$).

Hence, it should be appreciated that the embodiment of the invention described in relation to FIG. 5 is a non-limiting example of how the method of the invention may be put into practice. As already noted, the target top rail voltage 300 may be calculated using any suitable mathematical method(s), for example, using two separate data maps. However, it may be advantageous that the methods of the invention can be put into practice an minimal expense and that the target top rail voltage can be calculated rapidly, to allow for frequent adjustments (if necessary) during the operation of a vehicle engine. In an ECU 14 (which is suitably used to perform the method of the invention), increased memory space has a financial cost implication; and complexity of functionality and the quantity of data stored can adversely affect processing time/rate. In comparison to a linear scale factor (e.g. as depicted in sub-model 200), a data map (for example, data map 110) may require a relatively large amount of storage capacity (memory) and the interpolation of the data in the map can require a relatively large amount of processing time. Thus, in some embodiments, such as that depicted in FIG. 5, the piezoelectric stack temperature dimension, that could be included in an additional data map to that of 110 has been separated into a linear correction or scale factor, which requires significantly less memory and processing time to implement in an ECU 14. In some embodiments, it may be possible to calculate the target top rail voltage based on two or more linear corrections (scale factors) based on a default top rail voltage, so as to avoid the requirement for the data map 110.

The target top rail voltage (or third differential voltage level) may be calculated before or during a fuel injection event, provided that it has been determined before the start of the charging phase of the injection event (e.g. at point T2). Having determined the target third differential voltage level of the piezoelectric actuator 11 in dependence on the relevant engine parameters (e.g. rail pressure, $T_{on}$ and piezoelectric stack temperature), at the end of the fuel injection phase (T0 to T2), it is then necessary to begin re-charging the actuator 11 to that voltage level (i.e. during T2 to T3).

It is also important that at the desired end of the fuel injection phase, the injection of fuel into a cylinder of an engine is stopped rapidly and with the appropriate kinetics or injector closing profile. In this regard, the end of a fuel injection phase at T2 is controlled (in a de-energise to inject injector) by the extension of the piezoelectric stack 9 of the actuator 11 in response to an increase in the charge on the piezoelectric stack (or the voltage across the actuator terminals).

One factor that influences the rate of extension of the piezoelectric stack 9 is the magnitude of the charge current ($I_{CHARGE}$) that is supplied to the actuator 11. Since the charge current causes the closing of a fuel injector in a de-energise to inject injector, the charge current may also be called the "closing current". The charge current ($I_{CHARGE}$) is suitably determined by an ECU 14 of an engine in a known manner: for example, according to the intended closing profile of a fuel injector (12*a*, 12*b*). The charge current may also be selected according to the piezoelectric characteristics/properties of the piezoelectric material of the actuator 11. In one embodiment of the invention, the ECU 14 sets a default charge current ($I_{CHARGE\text{-}DEFAULT}$), at which initial rate the actuator 11 is re-charged at T2 in the absence of any additional influencing factors. This initial rate of charging the piezoelectric stack may be considered to represent the primary closing current of the fuel injection event. In some embodiments, it is desirable to reduce the rate at which the piezoelectric actuator 11 is re-charged as the differential voltage across the actuator approaches the target third differential voltage level. In these embodiments, an ECU 14 may apply a secondary closing current of lower magnitude than the primary closing current. Similar current control mechanisms may be considered for the discharge current between T0 and T1.

Figure 6:
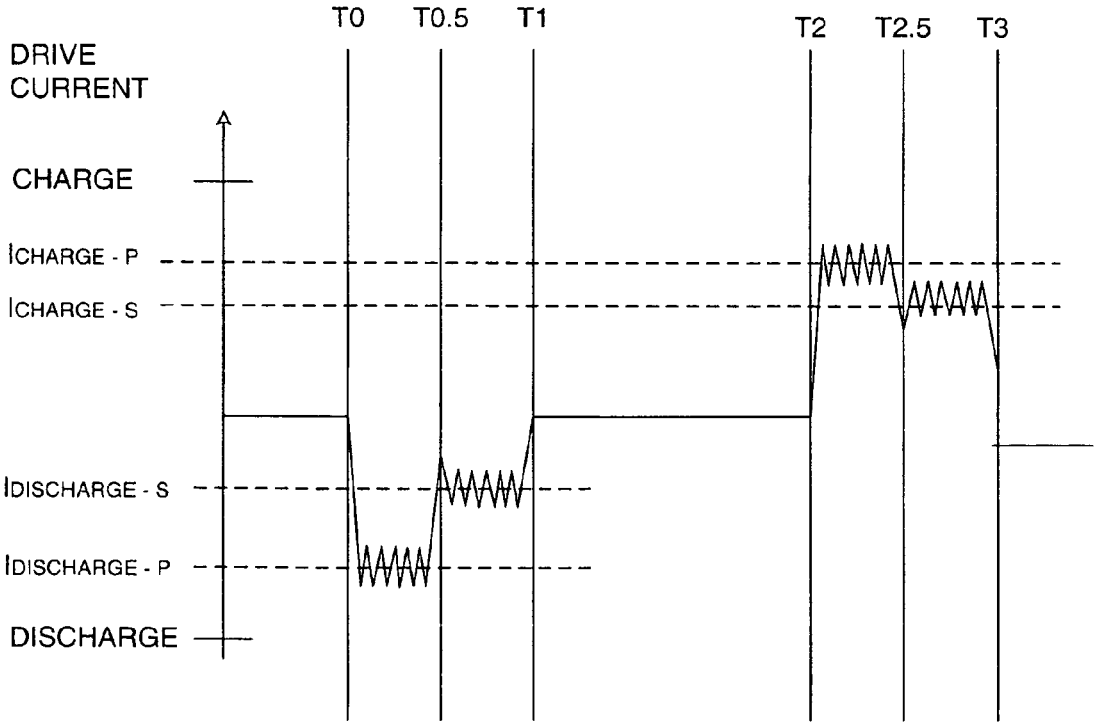
FIG. 6 shows an idealised drive current profile in accordance with another embodiment of the invention.

In relation to the above, FIG. 6 illustrates an alternative method of controlling a fuel injection event in accordance with another embodiment of the invention. In this operating cycle the discharge phase (T0 to T1) and the charge phase (T2 to T3) each comprise primary and secondary phases, respectively. The primary and secondary phases may be characterised by the time period of the respective discharging and charging phases and/or by the electrical characteristics of the discharge and charge phases. In the embodiment of FIG. 6 the discharge phase (T0 to T1) includes a primary discharge phase T0 to T0.5 during which the discharge current flowing from the actuator is at a first, approximately constant current level ($I_{DISCHARGE\text{-}P}$); and a secondary discharge phase T0.5 to T1 during which the discharge current is at a second, reduced, approximately constant current level of $I_{DISCHARGE\text{-}S}$. Similarly, the charge phase (T2 to T3) includes a primary charge phase T2 to T2.5 during which the charge current flowing to the actuator is at a first current level ($I_{CHARGE\text{-}P}$), and a secondary charge phase T2.5 to T3 during which the charge current is at a reduced level of RMS level $I_{CHARGE\text{-}S}$. In the embodiment illustrated, the secondary phases of the discharge and charge phases each comprise approximately the final 50% of the total duration of the discharge and charge phases, respectively. However, it will be appreciated that the secondary discharge phase may comprise any proportion below 100% of the total time period of the discharge phase: for example, at least 95%, at least 90%, at least 80%, 70%, 60% or at least 50%. In some embodiments, the secondary discharge phase comprises 50% or less of the total duration of the discharge phase, such as up to 40%, 30%, 20% or 10%. In some fuel injection events, it is advantageous that the secondary discharge phase comprises the majority of the discharge phase, e.g. from 50 to 95%.

A benefit of these embodiments is that the physical response of the actuator (i.e. the contraction of the piezoelectric stack) to the rapid removal of charge from the piezoelectric stack is less severe towards the ends of the discharge phase. In this way, the large physical stress that is experienced by the piezoelectric actuator as the relatively large discharge current is rapidly switched off (causing a rapid change in the rate of contraction) can be reduced. Without being bound by theory, in some fuel injectors, a piezoelectric actuator may be arranged such that it is physically stronger under extension than it is when it is relatively contracted. Therefore, the external forces exerted on a piezoelectric actuator at the end of a period of contraction can be more likely to damage the piezoelectric actuator. Accordingly, it can be beneficial to apply a discharge phase comprising a primary and a secondary discharge phase, wherein the discharge current during the secondary discharge phase ($I_{DISCHARGE\text{-}S}$) is less than the discharge current during the primary discharge phase ($I_{DISCHARGE\text{-}P}$).

In some fuel injection events, for example, those requiring only a small fuel injection (e.g. at low rail pressure), or for a pre-injection at high rail pressure, the discharge phase may comprise a primary discharge current only. This method may be suitable for such small fuel injection events, because only a small amount of charge is removed from the piezoelectric stack (the opening discharge), and so the stresses experienced by the piezoelectric actuator are relatively low. As a general rule, the shorter the $T_{on}$ of a fuel injection event, the smaller the proportion of the discharge phase that is comprised of the secondary discharge phase.

Similarly, in some embodiments the charge phase (T2 to T3) may comprise a primary discharge phase (T2 to T2.5) of current $I_{CHARGE\text{-}P}$, and a secondary charge phase (T2.5 to T3) of current $I_{CHARGE\text{-}S}$. The secondary charge phase may comprise any proportion of the total charge phase, as described in relation to the discharge phase above. Also, as with the discharge phase, where there is a secondary charge phase, beneficial, the charge current during the secondary charge phase ($I_{CHARGE\text{-}S}$) is less than the charge current during the primary charge phase ($I_{CHARGE\text{-}P}$). Typically, the existence, duration and current level of the secondary charge phase is selected independently of the existence, duration and current level of the secondary discharge phase.

In some fuel injection events, both the discharge and charge phases have primary and secondary phases, wherein each secondary phase is characterised by having a lower current than in the respective primary phase. In an advantageous method of the invention, the discharge phase has a primary and a secondary phase, while the charge phase of the same fuel injection event has a primary phase only.

To regulate the discharge current, an ECU may first determine the amount of opening discharge required to open the fuel injector by the required amount for the required time period ($T_{on}$) to meet the fuel demand of the engine. An ECU also typically determines the amount of opening discharge (i.e. charge removal from the piezoelectric stack) that is required to open the fuel injector by the required amount. The ECU may then set a RMS discharge current value to meet the required opening discharge over the duration of the injection event ($T_{on}$). Typically, the RMS discharge (and charge) current is controlled by setting upper and lower threshold current levels and during the discharge (or charge) phase, the discharge switch Q2 (or charge switch Q1, respectively) is opened and closed at a frequency dependent on those threshold discharge values, in a recognised manner. This is known as amplitude modulation of the discharge and charge currents. Where the fuel injection event includes a primary and a secondary discharge phase, for example, each phase has a different set of threshold current levels and the discharge switch Q2 is operated accordingly.

It should be appreciated that despite the optional inclusion of a secondary discharge phase and/or a secondary charge phase of lower current level that the respective primary phases, and despite the increased risk of damage to a piezoelectric actuator that may be associated with rapid changes in length, it is generally desirable that the discharge and charge phases have sharp onsets at points T0 and T2, respectively, so that the actuator responds rapidly to a signal to begin or terminate a fuel injection event.

In a conventional prior art fuel injection system where the top rail voltage is kept constant, the opening and closing currents are typically predetermined and stored in an ECU. In this way, it is generally intended that each main fuel injection event should have the same profile (e.g. in terms of injector opening and closing velocity and distance), such that a known rate and amount of fuel injection can be achieved. However, the present invention recognises that this prior art mode of operation of a piezoelectric injector does not achieve the same fuel injection profile/pattern under all engine conditions, nor under varying energised differential voltage levels across the piezoelectric actuator.

In this regard, the rate of length change of a piezoelectric stack (and hence the opening and closing profile of a piezoelectric fuel injector) may be influenced by one or more variable engine parameters in addition to the magnitude of the opening and closing current. In accordance with the invention, the variable engine parameters that may be considered are selected from: rail pressure, the top rail voltage ($V_{HI}$) applied to the actuator 11, and/or piezoelectric stack temperature. In another embodiment, the variable engine parameters that may be considered are selected from: rail pressure, the energised differential voltage level of the actuator 11 ($V_0$), and/or piezoelectric stack temperature.

Thus, in accordance with the invention, the charge current ($I_{CHARGE}$) may be calculated in dependence on one or more of rail pressure, top rail voltage ($V_{HI}$) and piezoelectric stack temperature. In an advantageous embodiment an ECU 14 calculates the charge current from a default charge current ($I_{CHARGE\text{-}DEFAULT}$) by adjusting the default current in dependence on the selected one or more engine parameters, to obtain a target charge current ($I_{CHARGE}$) that includes one or more compensations in respect of the prevailing engine conditions. In a particularly advantageous embodiment the target charge current ($I_{CHARGE}$) is calculated by compensating a default charge current for existing (or the most recently measured/estimated) values of rail pressure, top rail voltage ($V_{HI}$) and piezoelectric stack temperature. The default charge current may be determined during engine testing according to ideal or average engine parameters, by way of example. This default charge current may, for example, be the charge current that would be applied in a conventional mode of operation in which a predetermined charge current is applied regardless of the prevailing engine conditions.

Referring once again to FIGS. 3 and 4, at T3, the piezoelectric actuator 11 has been re-charged to its third differential voltage level (V3; V3') and, at any point thereafter, a discharge phase may be commenced to initiate the next fuel injection event at a subsequent T0.

As with the closing current (or charge current) discussed above, the level of the discharge current or (opening current), $I_{DISCHARGE}$, removed from the piezoelectric stack to initiate a fuel injection event at T0 (in a de-energise to inject injector) is a significant factor in controlling the opening profile of the fuel injector, by controlling the rate of contraction of the piezoelectric stack. The ECU 14 may, therefore, be programmed to initiate a different discharge current depending on the intended fuel injection quantity (such as in dependence on the engine speed and load). Thus, in one embodiment of the invention, the ECU 14 sets a default discharge current ($I_{DISCHARGE\text{-}DEFAULT}$) at which rate the actuator 11 is discharged at T0 in the absence of any compensations for influencing factors associated with relevant engine parameters.

However, as noted above, the invention recognises that the response of the piezoelectric actuator 11 to a predetermined default discharge current may be influenced by one or more variable engine parameters. By way of example, the beneficial reduction in the energised differential voltage across the piezoelectric actuator achieved by the methods of the invention may mean that, in some embodiments, the top rail voltage ($V_{HI}$) of a drive circuit used to re-charge the piezoelectric actuator may vary from one fuel injection event to another. Since a piezoelectric actuator 11 may respond differently to a particular magnitude of discharge current (e.g. a default discharge current, $I_{DISCHARGE\text{-}DEFAULT}$), depending on the differential voltage across the actuator at T0; in one embodiment, the invention advantageously determines the discharge current in dependence on the differential voltage across the piezoelectric actuator 11 in its charged state (i.e. $V_3$ and/or $V_0$) Suitably, the discharge current is determined in dependence on the differential voltage across the actuator 11 immediately before a discharge event at T0, i.e. at the differential voltage $V_0$. It will be appreciated that in some embodiments, the discharge current may be selected in dependence on the top rail voltage ($V_{HI}$) of the drive circuit 20*a*, because, provided the piezoelectric actuator 11 is re-charged to the voltage of the top rail and the voltage of the low rail ($V_{LO}$) is known.

Other variable engine parameters, in particular, rail pressure and piezoelectric stack temperature, may also affect the response of the piezoelectric actuator to a particular (e.g. default) discharge current. In this regard, the temperature of the piezoelectric stack can affect the amount of charge that is stored on a piezoelectric actuator at a particular differential voltage level.

Accordingly, the invention advantageously calculates the discharge current ($I_{DISCHARGE}$) in dependence on one or more of rail pressure, the differential voltage level across the actuator 11 ($V_0$), and the piezoelectric stack temperature; to obtain a target discharge current that is compensated for the prevailing engine conditions. More advantageously, the target discharge current ($I_{DISCHARGE}$) is calculated by compensating a default discharge current for existing (or the most recently measured/estimated) parameters including rail pressure, the differential voltage level across the actuator 11 ($V_0$ or $V_3$), and the piezoelectric stack temperature. Since the discharge current causes the opening of a fuel injector in a de-energise to inject injector, the discharge current may also be called the opening current. Suitably, the discharge current ($I_{DISCHARGE}$) is calculated by an ECU 14 for the next fuel injection event at any point before T0. The discharge current is conveniently calculated during the T3 to T0 phase, during which time the exact value of the energised differential voltage level of the actuator can be known.

As noted, it may also be beneficial to reduce the rate of discharge of a piezoelectric actuator before the end of the discharge phase, T0 to T1, so that there is not such a sharp change in the rate of contraction of the piezoelectric stack at the end of the discharge phase and, therefore, the physical stress experienced by the piezoelectric actuator may be reduced. Accordingly, the invention may comprise applying a primary discharge current of a first magnitude for a period (T0 to T0.5), followed by a secondary discharge current of reduced magnitude for a period (T0.5 to T1), as previously described.

The discharge current (or opening current) is applied until the required, predetermined voltage drop across the piezoelectric actuator is achieved to achieve the desired second differential voltage level of the piezoelectric actuator 11 ($V_1$). The amount of charge removed from the piezoelectric actuator 11 to achieve and maintain the fuel injection event by changing the differential voltage from the first level, $V_0$, to the second level, $V_1/V_2$ (i.e. between T0 and T2), may conveniently be termed the "opening discharge", because this is the amount of charge removed from the piezoelectric stack to open the fuel injector. The length of the piezoelectric stack at the second differential voltage level affects the extent to which a piezoelectric fuel injector opens to inject fuel and, in combination with fuel pressure, the rate and quantity of fuel that can be injected into an associated cylinder of an engine during the dwell period of the injector (T1 to T2).

In one embodiment, the piezoelectric actuator 11 may be discharged to a predetermined second (low) differential voltage level at T1. In this way, the discharged voltage level of the piezoelectric actuator 11 is determined independently of the charged voltage level of the actuator.

In another embodiment, as is typical of some prior art fuel injection systems, the method of the invention operates to discharge the piezoelectric actuator 11 by a predetermined differential voltage drop (for example, 250 V), irrespective of the first differential voltage level of the piezoelectric actuator 11. The predetermined voltage drop may be selected on the basis of engine demand, in a known manner. For example, for a main injection event the predetermined voltage drop may be 250 V; while if an engine is at idle, or to cause a pre-injection, the predetermined voltage drop may be as low as 50 V.

However, yet another consequence of having a variable high differential voltage across the piezoelectric actuator in its charged state is that, for a predetermined voltage drop across the actuator 11 (e.g. to open a fuel injector), the actuator may be discharged to a variable low differential voltage level (i.e. the second differential voltage level). By way of example, if a default discharge voltage drop of 200 V is implemented to initiate a main fuel injection event, then at a pre-discharge voltage of +200 V, the actuator will be discharged to 0 V; whereas if the pre-discharge voltage across the actuator is at a reduced level of 170 V, for example, then the same change in differential voltage will result in a lower second differential voltage level of −30 V.

The invention recognises that the opening and closing profile of a fuel injector (which is dependent on both the length and speed of piezoelectric stack contraction/extension), may depend on both the absolute differential voltage levels across the piezoelectric stack in its charged and discharged states (including the change in the differential voltage between the energised and de-energised states of the actuator 11), and the speed at which the actuator is charged or discharged (i.e. the charge or discharge current). Thus, by varying the charged differential voltage level of a piezoelectric actuator (i.e. the third differential voltage level), the opening profile of an associated fuel injector may also change for any predetermined (default) differential voltage drop and default discharge current ($I_{DISCHARGE}$) used to initiate a subsequent fuel injection event at T0. Hence, the above-described changes in the energised differential voltage levels across a piezoelectric actuator may result in different fuel injection profiles and, consequently, in the injection of different quantities of fuel under different engine conditions and the failure to accurately match engine fuel demand.

To address this issue, the methods of the invention may suitably further comprise an opening discharge compensation, which modifies the opening discharge, if necessary, in dependence on one or more engine parameters. The one or more engine parameters are suitably selected from rail pressure, the differential voltage level across the charged actuator 11 (i.e. the first or third differential voltage level), and the piezoelectric stack temperature. In one embodiment, the opening discharge is calculated in dependence on rail pressure, the charged differential voltage level across the actuator 11 ($V_0$), and the piezoelectric stack temperature. The opening discharge compensation may, as for the previously described compensations, be calculated from a default opening discharge level, which may be predetermined during engine testing/set-up, for example. The level of the default opening discharge level may be selected in dependence on fuel demand levels of the engine, such as from a look-up table, data map or other function, and may be based on a predetermined first differential voltage level. Typically, the first differential voltage level is known by the ECU 14 or can be measured. It will, of course, be appreciated that the first differential voltage level is equivalent to the third differential voltage level in a series of more than one fuel injection events.

Advantageously, the invention comprises applying at least one of: (i) an opening current compensation to select an opening current at which rate to discharge the piezoelectric stack at T0 in order to initiate a fuel injection event; (ii) a closing current compensation to select a closing current at which rate to charge the piezoelectric stack at T2 in order to end a fuel injection event; and (iii) an opening discharge compensation to select the amount of charge removed from the piezoelectric stack when a fuel injection event is taking place (i.e. between T0 to T2). In this way, the profile of a fuel injection event, including the rate and quantity of fuel injected by the fuel injector can be adjusted in dependence on the one or more engine parameters. In a more advantageous embodiment, the invention may comprise applying all three of: an opening current compensation; a closing current compensation; and an opening discharge compensation. A non-limiting example of how this advantageous embodiment may be implemented is described below with reference to FIG. 7.

Figure 7:
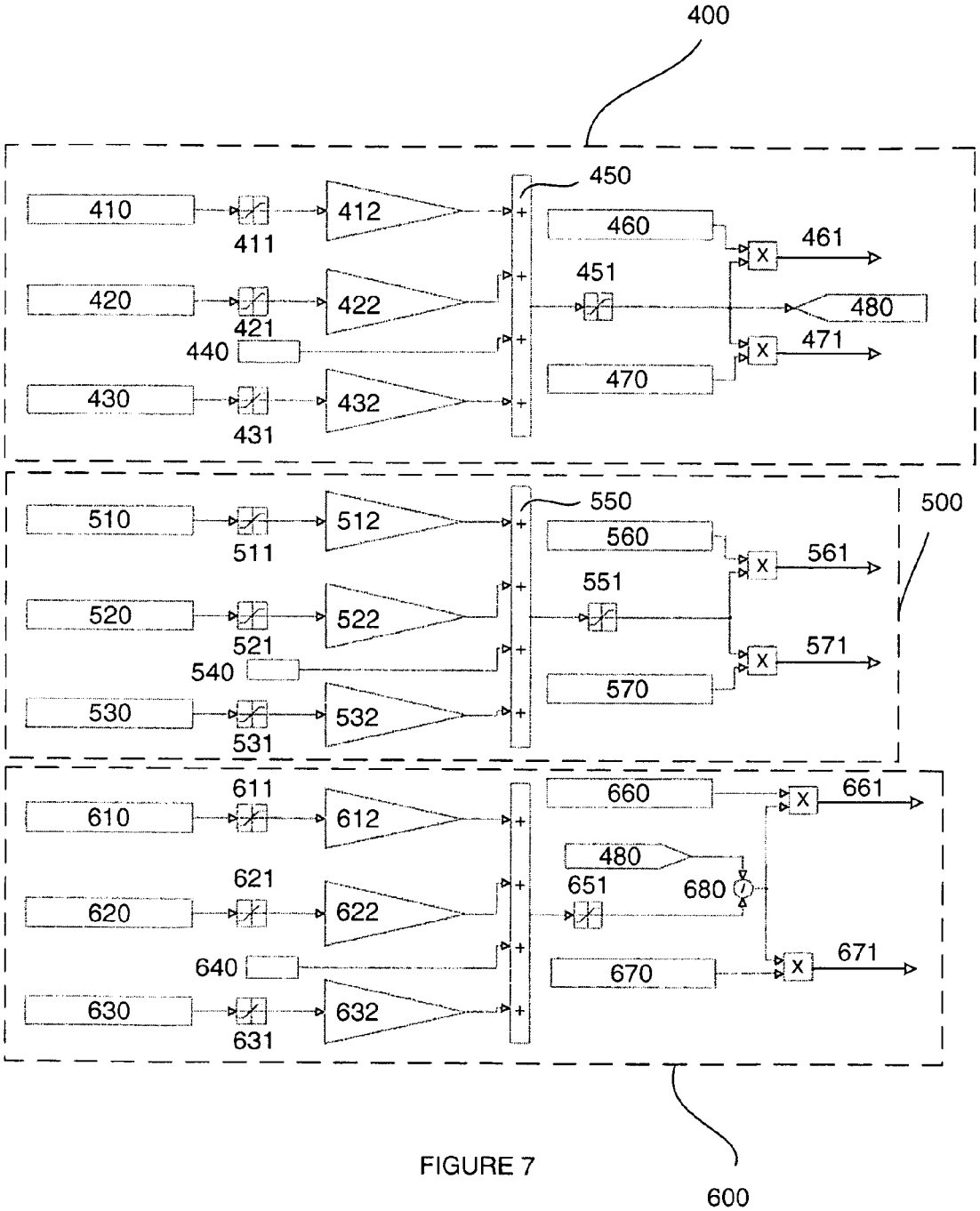
FIG. 7 is a control flow diagram to illustrate the steps to calculate the opening current compensation, closing current compensation and opening discharge compensation that may be applied to a piezoelectric actuator of a fuel injector, in accordance with an embodiment of the invention.

FIG. 7 is a control flow diagram illustrating the steps that may be taken to calculate (A) the opening current compensation 400; (B) the closing current compensation 500; and (C)

the opening discharge compensation 600 in a fuel injector. Each of the compensations (400, 500 and 600) are conveniently applied to predetermined default values of opening current, closing current and opening discharge to obtain the target level for the opening current, closing current and opening discharge, respectively.

To calculate an opening current compensation 400, first the levels of rail pressure 410, energised differential voltage level ($V_0$) 420 and piezoelectric stack temperature 430 in an engine are determined either by measurement or by estimation. Advantageously, the determinations of each of rail pressure 410, energised differential voltage level ($V_0$) 420, and piezoelectric stack temperature 430 are made immediately before the next fuel injection event, such as during the fuel injection event immediately preceding that for which the compensation is being calculated. Where it is not possible to use such a recent measurement or estimation, the most recently obtained determination for each parameter may be used. To this end, the memory of an ECU 14 may be used to store relatively recent values of engine parameters.

The determined rail pressure 410 is compared to a saturation curve 411, which may be used to set the rail pressure element of the opening current compensation 400 to 0 if the rail pressure 410 is determined to fall in a range in which the piezoelectric stack is insensitive to changes in opening current. By way of example, in one embodiment, when the fuel pressure is below 800 bar, the piezoelectric stack is sensitive to changes in opening current, whereas at fuel pressures above 800 bar, changes in opening current do not affect the response of the piezoelectric actuator 11.

Similarly, the values determined for the energised differential voltage level ($V_0$) and the piezoelectric stack temperature 430 are compared to saturation curves 421 and 431, respectively, to nullify any opening current compensations where the energised differential voltage level ($V_0$) and piezoelectric stack temperature are at levels at which the piezoelectric actuator 11 is insensitive to changes in opening current.

At 412 the determined value of rail pressure 410 is referenced to a predetermined linear scale function in order to calculate a gain (or adjustment) proportional to the affect of the determined rail pressure 410 on the response of the piezoelectric actuator 11 at the predetermined default opening current. For example, the fuel pressure gain is less than one when the fuel pressure 410 is determined to be at a level at which the piezoelectric actuator 11 is more sensitive to changes in opening current than it is under the predetermined default conditions; and the gain is more than one under to opposition conditions. In this way, the target opening current ($I_{DISCHARGE}$) is increased relative to the default opening current ($I_{DISCHARGE\text{-}DEFAULT}$) when the piezoelectric actuator 11 is exposed to fuel pressures at which it becomes less sensitive to opening current and vice versa.

Likewise, at 422 and 432 the determined values of the energised differential voltage level ($V_0$) 420 and the piezoelectric stack temperature 430 are compared, respectively, to predetermined linear scale functions of energised differential voltage level ($V_0$) and piezoelectric stack temperature, to calculate gains that are proportional to the affects of the determined energised differential voltage level ($V_0$) 420 and piezoelectric stack temperature 430, respectively, on the response of the piezoelectric actuator 11 at the predetermined default opening current.

At 450 the combined gain or scale factor (i.e. the balance of the individual gains 412, 422 and 432) is calculated by adding the individual gain values with a constant 440. Constant 440 is necessary to create the correct four-dimensional surface relating the three engine parameters to the target opening current.

The total gain 450 is then compared to another saturation curve 451, which functions to ensure that the target opening current is maintained within acceptable levels for the operation of the piezoelectric actuator 11. Thus, by way of example, if the default opening current is x amps, but it has been previously determined that opening currents above 2x amps or below 0.5x amps adversely affect the operation of a piezoelectric actuator and are unacceptable, then the saturation curve 451 would moderate any combined gain 450 values to within the acceptable limits of 0.5 to 2.0.

The combined gain 450, which may have been moderated in accordance with saturation curve 451 is applied to the default opening current ($I_{DISCHARGE\text{-}DEFAULT}$) so as to calculate the target opening current ($I_{DISCHARGE}$). In the embodiment depicted, the opening current comprises a default primary opening current 460 ($I_{DISCHARGE\text{-}DEFAULT\text{-}P}$) and a default secondary opening current 470 ($I_{DISCHARGE\text{-}DEFAULT\text{-}S}$), which may be the same or different. The target primary opening current 461 ($I_{DISCHARGE\text{-}P}$) and target secondary opening current 471 ($I_{DISCHARGE\text{-}S}$) are finally calculated by multiplying the default values by the same scale factor or gain 451. The percentage or proportional change in the opening current 480 is used to calculate the opening discharge compensation according to the scheme 600.

To calculate a closing current compensation 500, the levels of rail pressure 510, energised differential voltage level ($V_0$) 520 and piezoelectric stack temperature 530 in an engine are determined either by measurement or by estimation (as above). It should be noted that the values of rail pressure 510, energised differential voltage level ($V_0$) 520 and piezoelectric stack temperature 530 are the same as the corresponding values 410, 420 and 430, where an opening current compensation is also to be calculated.

As for the calculation of the opening current compensation in 400, the determined values of rail pressure 510, energised differential voltage level ($V_0$) 520 and piezoelectric stack temperature 530 are referenced against saturation curves 511, 521 and 531, respectively, to nullify potential closing current compensations under conditions of fuel pressure 510, energised differential voltage level ($V_0$) 520 and/or piezoelectric stack temperature 530 at which the piezoelectric actuator 11 is insensitive to changes in closing current.

At 512 a scale factor or gain is obtained for the proportion by which the default closing current must be adjusted to compensate for the effects on the piezoelectric actuator 11 of the prevailing fuel pressure 510. As at 412 above, the gain is conveniently calculated by reference to a predetermined linear scale function relating fuel pressure to the response of a piezoelectric actuator 11 to changes in closing current. Similarly, at 522 and 532 the determined values of the energised differential voltage level ($V_0$) 520 and the piezoelectric stack temperature 530 are compared, respectively, to predetermined linear scale functions of energised differential voltage level ($V_0$) and piezoelectric stack temperature, to calculate individual gains that are proportional to the affects of the determined energised differential voltage level ($V_0$) 520 and piezoelectric stack temperature 530, respectively, on the response of the piezoelectric actuator 11 at the predetermined default closing current.

At 550 the balance of the individual gains for each of the engine parameters is calculated by adding the individual gain values with a constant 540. The total gain 550 is then compared to another saturation curve 551, which functions to ensure that the eventual target closing current is maintained within acceptable levels for the operation of the piezoelectric actuator 11 (as discussed in relation to the target opening current above).

The value of the combined gain 550 (which may have been moderated by the saturation curve 551) is applied to the default closing current ($I_{CHARGE\text{-}DEFAULT}$) in order to generate a target closing current ($I_{CHARGE}$). The closing current also comprises a default primary closing current 560 ($I_{CHARGE\text{-}DEFAULT\text{-}P}$) and a default secondary closing current 570 ($I_{CHARGE\text{-}DEFAULT\text{-}S}$), which may be the same or different. The target primary closing current 561 ($I_{CHARGE\text{-}P}$) and target secondary closing current 571 ($I_{CHARGE\text{-}S}$) are determined by multiplying the default values by the same scale factor or gain obtained from 551.

The opening discharge compensation 600 is beneficially calculated by first determining the value of the rail pressure 610, the energised differential voltage level ($V_0$) 620 and the piezoelectric stack temperature 630 in an engine as previously described. These variables are the same as the respective variables 410 and 510, 420 and 520, and 430 and 530, respectively.

As for the opening and closing current compensations (400 and 500), the calculated engine parameters 610, 620 and 630 are compared to the saturation curves 611, 621 and 631, respectively, to remove the possibility of a compensation under engine conditions where the piezoelectric actuator 11 is insensitive to changes in opening discharge.

Scale factors/gains 612, 622 and 632 are next determined, for example, by reference to predetermined linear scale functions, to provide an adjustment to the opening discharge to compensate for the effects on the piezoelectric actuator 11 of the parameters 610, 620 and 630, respectively. An overall gain 650 is then calculated by adding the individual gain values with a constant 640, and this may be adjusted by reference to a saturation curve 651, if necessary, for the reasons already given.

In the embodiment depicted, to adjust the opening discharge from the piezoelectric actuator, the time at which the discharge current is initiated (i.e. T0) is typically kept constant, i.e. there is a predetermined T0. In contrast, the point T1 and hence, the opening time (T1−T0) is adjusted relative to a default opening time. In this way, for any given (e.g. default) opening current, the opening discharge from the piezoelectric actuator is increased by extending the opening time T1−T0, and is decreased by reducing the opening time T1−T0. The opening discharge compensation in the embodiment depicted includes a value for a primary opening time (T0.5−T0) 660 and a secondary opening time point (T1−T0.5) 670. It will be understood that T0.5 corresponds to the time point at which the secondary discharge (or opening) current is initiated. Thus, at 651 a compensated scale factor is obtained, which indicates the proportional or percentage change that is required in the opening discharge from the piezoelectric actuator 11 to compensate for the values of fuel pressure, energised differential voltage level ($V_0$) and piezoelectric stack temperature.

The opening discharge on the piezoelectric actuator can be affected by any changes in the opening current calculated in 400, and also by any changes in the opening time, T1−T0 (i.e. the time period during which an opening or discharge current is removed from the actuator). Therefore, at 680, the percentage or proportional change in the opening current 480 is divided by the required percentage or proportional change in the opening discharge to determine whether any compensation is required in the primary 660 and secondary 670 opening times. By way of example, if the opening current compensation 400 calculates that a 10% increase is necessary in the opening current, then a corresponding 10% increase in the opening discharge from the piezoelectric actuator 11 will result without any changes to the default primary and secondary opening times 660 and 670, respectively. Therefore, if at 651 the required opening discharge compensation is calculated to be 0%, then to compensate for a 10% increase in opening current it will be necessary to shortened the primary 660 and secondary 670 opening times by 10%.

Thus, the compensated value of the primary opening time 661 is calculated as the product of the additional compensation determined at 680 (for the required opening current and opening discharge compensations) and the default primary opening time 660. Similarly, the product of the additional compensation 680 and the default secondary opening time 670 is calculated to determine the compensated secondary opening time 671. Typically, the same proportion or percentage compensation change is applied to both the primary and secondary opening times.

The model described in FIG. 7 represents one way in which compensations in opening current, closing current and opening discharge may be calculated having regard to three engine parameters: fuel pressure; energised differential voltage level; and piezoelectric stack temperature. The skilled person may, for example, devise other mathematical models or equations based on the engine parameters of the exemplified embodiment. Furthermore, additional compensations and/or additional engine parameters may be used in the calculation of the selected compensations for controlling fuel injection events. Therefore, the embodiments described above are not intended to be in any way limiting to the scope of the invention as set out in the claims.

It will also be appreciated that the method steps recited hereinbefore and in the claims need not, in all cases, be performed in the order in which they are introduced, but may be reversed or re-ordered whilst still providing the advantages associated with the invention, which is defined by the appended claims.

Where the methods of the invention determine that the differential voltage level across a piezoelectric actuator in a de-energise to inject injector may be reduced, the embodiments described above are not to be limited to a particular means of lowering the differential voltage level across the charged piezoelectric actuator. For instance, the charged differential voltage level may be lowered by active or passive mechanisms. In a passive mechanism the top rail voltage ($V_{HI}$) in a drive circuit used to re-charge the actuator is allowed to gradually decrease following each fuel injection event by not re-charging. Active mechanisms include: (i) changing the charging times of the piezoelectric actuator to prevent the piezoelectric actuator re-charging to the full voltage ($V_{HI}$) of the top rail; and (ii) actively lowering the top rail voltage ($V_{HI}$) by manipulating the function of a drive circuit, but optionally allowing the piezoelectric actuator to re-charge to the full voltage of the top rail. In some embodiments it is preferred to use a passive mechanism for lowering the differential voltage across the piezoelectric actuator, but in some circumstances, it may be preferable to use an active mechanism, for example, to more rapidly lower the differential voltage across the charged actuator.

The invention may also provide a method of operating a fuel injector including a piezoelectric actuator comprising a piezoelectric stack, and wherein, in use, the injector communicates with a fuel rail; the method comprising: (a) applying a discharge current ($I_{DISCHARGE}$) to the actuator for a discharge period (T0 to T1) so as to discharge the stack from a first differential voltage level ($V_0$) across the stack to a second differential voltage level ($V_1/V_2$) across the stack (so as to initiate an injection event); (b) maintaining the second differential voltage level for a period of time (T1 to T2; the "dwell period"), (during which the injection event is maintained); and (c) applying a charge current ($I_{CHARGE}$) to the actuator for a charge period (T2 to T3; T2 to T3') so as to charge the stack from the second differential voltage level to a third differential voltage level ($V_3$) (so as to terminate the injection event); wherein the third differential voltage level ($V_3$) is selected in dependence on at least one engine parameters, the at least one engine parameters selected from: fuel pressure in the fuel rail (referred to as "rail pressure", or "P"); $T_{on}$ (the on-time of the fuel injection event); and the piezoelectric stack temperature (Temp); and wherein the method further comprises applying at least one of: (i) a discharge current compensation to select the discharge current ($I_{DISCHARGE}$) used to discharge the stack in step (a); (ii) a charge current compensation to select the charge current ($I_{CHARGE}$) used to charge the stack in step (c); and (iii) an opening discharge compensation to select the amount of charge removed from the stack to achieve the second differential voltage level in step (b); wherein the various engine parameters and method steps are as described herein.

The invention claimed is:

1. A method of operating a fuel injector including a piezoelectric actuator having a stack of piezoelectric elements, and wherein, in use, the injector communicates with a fuel rail, the method comprising:

(a) applying a discharge current to the actuator for a discharge phase (T0 to T1) so as to discharge the stack from a first differential voltage level across the stack to a second differential voltage level across the stack so as to initiate an injection event;

(b) maintaining the second differential voltage level for a period of time (T1 to T2, defined as the "dwell period"); and (c) determining at least two engine parameters, the at least two engine parameters being selected from: fuel pressure in the fuel rail; the discharge period (T0 to T2) of the next fuel injection event (defined as the "electric pulse time"); and the piezoelectric stack temperature; and (d) applying a charge current to the actuator for a charge period so as to charge the stack from the second differential voltage level to a third differential voltage level so as to terminate the injection event;

wherein the third differential voltage level is selected in dependence on the at least two engine parameters.

2. The method of claim 1, wherein the step of determining the at least two engine parameters includes measuring the at least two engine parameters:

(1) prior to the start of the discharge period; or (2) during the discharge period; or (3) during the dwell period.

3. The method of claim 1, wherein the third differential voltage level is selected in dependence on at least rail pressure and the electric pulse time.

4. The method of claim 1, wherein the third differential voltage level is a function of rail pressure, the electric pulse time, and piezoelectric stack temperature.

5. The method of claim 1, wherein the third differential voltage level is selected from one or more look-up tables, data maps, equations or scale functions based on calibration data.

6. The method of claim 1, wherein the rail pressure is measured using a pressure sensor arranged to measure the pressure of fuel within the rail.

7. The method of claim 1, wherein the electric pulse time is determined as a function of one or more of engine load, engine speed and throttle position.

8. The method of claim 1, wherein step of applying a charge current to the actuator is controlled by a drive circuit, the drive circuit comprising a high voltage rail at voltage $V_{HI}$, a low voltage rail at voltage $V_{LO}$, wherein the high voltage rail and the low voltage rail are connectable to respective terminals of the piezoelectric actuator; and wherein the third differential voltage of the piezoelectric actuator is the voltage differential between the $V_{HI}$ and $V_{LO}$.

9. The method of claim 8, wherein the drive circuit includes an apparatus for controlling the voltage of the high voltage rail; and wherein, subsequent to selecting the third differential voltage level in dependence on the at least two engine parameters, the voltage of the high voltage rail is controlled to achieve the selected third differential voltage level.

10. The method of claim 9, wherein a target third differential voltage level is selected by the process of: obtaining a first output from a data map relating rail pressure and the electric pulse time to a desired third differential voltage level; and obtaining a second output by applying a scale function based on piezoelectric stack temperature to the first output; wherein the second output relates to the target third differential voltage level.

11. The method of claim 1, wherein a target third differential voltage level is selected by the process of:

obtaining a first output from a first data map relating rail pressure and the electric pulse time to a desired third differential voltage level; and obtaining a second output from a second data map relating stack temperature and the first output to a desired third differential voltage level;

wherein the second output relates to the target third differential voltage level.

12. The method of claim 10, wherein the first and second outputs correspond to the voltage of the high voltage rail.

13. The method of claim 1, wherein step (d) comprises the steps of:

(b1) selecting the third differential voltage level;

(b2) applying a charge current to the actuator for a charge period so as to charge the stack from the second differential voltage level to an intermediate differential voltage level, wherein the intermediate differential voltage level is a level between the first and third differential voltage levels; and (b3) repeating steps (a), (b), (c), (b1) and (b2), wherein the intermediate differential voltage level obtained in a preceding step (b2) is taken as the first differential voltage level in a successive step (b1), until the intermediate differential voltage level is substantially equal to the third differential voltage level.

14. The method of claim 1, which further comprises applying at least one of:

(i) a discharge current compensation to select the discharge current used to discharge the stack in step (a);

(ii) a charge current compensation to select the charge current used to charge the stack in step (d); and (iii) an opening discharge compensation to select the amount of charge removed from the stack to achieve the second differential voltage level in step (b).

15. The method of claim 14, wherein the discharge current compensation, the charge current compensation and the opening discharge compensation are each determined in dependence on at least one engine parameter selected from rail pressure, piezoelectric stack temperature, and the first differential voltage level.

16. The method of claim 1, further comprising applying:

(i) a discharge current compensation to select the discharge current used to discharge the stack in step (a);

(ii) a charge current compensation to select the charge current used to charge the stack in step (d); and (iii) an opening discharge compensation to select the amount of charge removed from the stack to achieve the second differential voltage level in step (b);

wherein the discharge current compensation, the charge current compensation and the opening discharge compensation are each independently determined as a function of rail pressure, piezoelectric stack temperature, and the first differential voltage level.

17. A method of operating a fuel injector including a piezoelectric actuator having a stack of piezoelectric elements, and wherein in use the injector communicates with a fuel rail, the method comprising:

(a) applying a discharge current to the actuator to discharge the stack from a first differential voltage level across the stack to a second differential voltage level across the stack so as to initiate an injection event, wherein the discharge current is determined by selecting a predetermined discharge current and applying a discharge current compensation to the predetermined discharge current so as to modify the predetermined discharge current in dependence on one or more engine parameters, (b) maintaining the second differential voltage level across the stack for a period of time; and (c) applying a charge current to the actuator so as to charge the stack from the second differential voltage level to a third differential voltage level so as to terminate the injection event, wherein the charge current is selected in dependence on at least two engine parameters selected from: fuel pressure in the fuel rail; the electric pulse time; and the piezoelectric stack temperature, wherein the charge current is determined by selecting a predetermined charge current and applying a charge current compensation to the predetermined charge current so as to modify the predetermined charge current in dependence on one or more engine parameters.

18. A drive circuit for a fuel injector including a piezoelectric actuator having a stack of piezoelectric elements, the drive arrangement comprising:

(A) a first element or elements for applying a discharge current to the actuator for a discharge period so as to discharge the stack from a first differential voltage level across the stack to a second differential voltage level across the stack so as to initiate an injection event;

(B) a second element or elements for maintaining the second differential voltage level for period of time;

(C) a third element or elements for applying a charge current to the actuator for a charge period so as to charge the stack from the second differential voltage level to a third differential voltage level so as to terminate the injection event; and (D) a fourth element or elements for determining at least two engine parameters prior to applying the charge current to the actuator such that the third differential voltage level to which the stack is charged is selected in dependence on the at least two engine parameters; and wherein the at least two engine parameters are selected from fuel pressure in the fuel rail; the electric pulse time; and piezoelectric stack temperature.

19. The drive circuit of claim 18, wherein the third differential voltage level to which the stack is charged is selected as a function of rail pressure; the electric pulse time; and piezoelectric stack temperature.

20. The drive circuit of claim 18, which further includes:

(E) a fifth element or elements for applying a discharge current compensation to select the discharge current used to discharge the stack, or (F) a sixth element or elements for applying a charge current compensation to select the charge current used to charge the stack, or (G) a seventh element or elements for applying an opening discharge compensation to select the quantity of charge to remove from the stack to achieve the second differential voltage; and (H) an eighth element or elements for determining at least one engine parameter prior to applying any of the discharge current compensation, the charge current compensation and the opening discharge compensation; and wherein the at least one engine parameter is selected from rail pressure, piezoelectric stack temperature, and the first differential voltage level.

21. The drive circuit of claim 20, wherein the discharge current compensation, the charge current compensation and the opening discharge compensation are each independently determined as a function of rail pressure, piezoelectric stack temperature, and the first differential voltage level.

22. A computer readable memory or storage device containing a computer program for execution by a computer, the computer program comprising a computer program software portion which, when executed, is operable to implement a method of operating a fuel injector including a piezoelectric actuator having a stack of piezoelectric elements, and wherein in use the injector communicates with a fuel rail, the implemented method comprising:

(a) applying a discharge current to the actuator for a discharge period so as to discharge the stack from a first differential voltage level across the stack to a second differential voltage level across the stack so as to initiate an injection event;

(b) maintaining the second differential voltage level for a period of time; and (c) applying a charge current to the actuator for a charge period so as to charge the stack from the second differential voltage level to a third differential voltage level so as to terminate the injection event;

wherein the third differential voltage level is selected in dependence on at least two engine parameters, the at least two engine parameters being selected from: fuel pressure in the fuel rail; the electric pulse time, and the piezoelectric stack temperature.

23. A data storage medium having the computer software portion of claim 22 stored thereon.

24. A microcomputer provided with the data storage medium of claim 23.

* * * * *